US005651445A

United States Patent [19]

Stevens et al.

[11] Patent Number: 5,651,445

[45] Date of Patent: Jul. 29, 1997

[54] APPARATUS FOR THE AUTOMATED PROCESSING OF BULK MAIL HAVING VARIED CHARACTERISTICS

[75] Inventors: Albert F. Stevens; Robert R. DeWitt, both of Moorestown; Michael E. York, Sicklerville, all of N.J.; David Keller, Newtown, Pa.; William R. Lile, Medford, N.J.

[73] Assignee: Opex Corporation, Moorestown, N.J.

[21] Appl. No.: 479,709

[22] Filed: Jun. 7, 1995

Related U.S. Application Data

[63] Continuation of Ser. No. 175,719, Dec. 29, 1993, Pat. No. 5,460,273, which is a continuation-in-part of Ser. No. 887, 621, May 22, 1992, Pat. No. 5,310,062, which is a continuation-in-part of Ser. No. 363,511, Jun. 8, 1989, Pat. No. 5,115,918, which is a division of Ser. No. 904,966, Sep. 5, 1986, Pat. No. 4,863,037.

[51] Int. Cl.[6] ..... B65G 47/26; B65H 3/44

[52] U.S. Cl. ..... 198/447; 198/434; 271/9.11; 271/9.12

[58] Field of Search ..... 198/447, 434; 271/9.02, 9.11, 9.12

[56] References Cited

U.S. PATENT DOCUMENTS

| | | | |
|---|---|---|---|
| 3,272,307 | 9/1966 | Waite | 198/447 |
| 3,647,044 | 3/1972 | Orstam | 198/447 |
| 4,161,244 | 7/1979 | Hunter et al. | 198/447 |
| 4,585,113 | 4/1986 | Greenwell | 198/347.2 |
| 4,863,037 | 9/1989 | Stevens et al. . | |
| 5,099,896 | 3/1992 | Ritola | 198/347.2 |
| 5,115,918 | 5/1992 | DeWitt et al. . | |
| 5,240,116 | 8/1993 | Stevens et al. . | |
| 5,310,062 | 5/1994 | Stevens et al. . | |
| 5,439,118 | 8/1995 | York . | |
| 5,441,159 | 8/1995 | DeWitt et al. . | |
| 5,460,273 | 10/1995 | Stevens et al. . | |

*Primary Examiner*—D. Glenn Dayoan
*Assistant Examiner*—Richard A. Chandler
*Attorney, Agent, or Firm*—Dann, Dorfman, Herrell and Skillman, P.C.

[57] ABSTRACT

An apparatus for the automated processing of bulk mail which incorporates a number of operating stations that serve to accomplish the various aspects of mail extraction, as well as the subsequent processing of extracted documents, and which are operatively associated with one another to serially process envelopes and extracted documents in continuous fashion and substantially independent of their characteristic features. To this end, the operating stations of the apparatus are configured to be as independent as possible of the characteristics of the envelopes and their contents so that envelopes and contents of varied characteristics can be effectively handled by the apparatus without requiring any significant adjustments. As a result, the apparatus is made capable of processing (as a single job if desired) envelopes and contents of varied characteristics, reducing the need to remove non-conforming envelopes and contents from further processing, and increasing the versatility and productivity of the apparatus.

23 Claims, 19 Drawing Sheets

APPARATUS FOR THE AUTOMATED PROCESSING OF BULK MAIL HAVING VARIED CHARACTERISTICS

RELATED CASES

This is a continuation of prior U.S. patent application Ser. No. 08/175,719, filed Dec. 29, 1993, and now U.S. Pat. No. 5,460,273, which is a continuation-in-part of U.S. Pat. application Ser. No. 07/887,621, filed May 22, 1992, and now issued as U.S. Pat. No. 5,310,062, dated May 10, 1994, which is a continuation-in-part of U.S. patent application Ser. No. 07/363,511, filed Jun. 8, 1989 and now issued as U.S. Pat. No. 5,115,918, dated May 26, 1992, which is in turn a division of U.S. patent application Ser. No. 06/904,966, filed Sep. 5, 1986 and now issued as U.S. Pat. No. 4,863,037, dated Sep. 5, 1989, the subject matter of each of which is incorporated by reference as if fully set forth herein.

BACKGROUND OF THE INVENTION

This invention relates generally to the automated processing of bulk mail, in particular, to the extraction of documents from envelopes in automated fashion.

A variety of organizations customarily receive mail in large quantities and in bulk form, and a number of devices have been developed to facilitate the handling of such mail so as to enhance productivity. One such productivity aid generally includes devices that are used for receiving mail (i.e., envelopes) in bulk form, and for extracting contents (i.e., documents) from such mail for subsequent processing. This may simply include an extraction of documents from envelopes, for subsequent processing making use of other devices, or by hand. However, such extraction may further include sorting procedures for directing specified types of envelopes to the extraction apparatus and/or orienting procedures for organizing the extracted documents prior to their further processing. An example of a comprehensive apparatus of this general type is the Opex System 100, which is manufactured by Opex Corporation of Moorestown, N.J. Such extraction may further include procedures for directing specified contents (generally invoices and checks) to so-called remittance processing equipment (e.g., the Model S4000, among others, manufactured by Unisys, of Detroit, Mich., and the Model 9400, among others, manufactured by BancTec (CES), of Dallas, Tex.) so that appropriate accounting information may be obtained and entered prior to stacking and subsequent processing (including deposit) of the documents. An example of a comprehensive apparatus of this general type is the Opex MPE 5.0, which is also manufactured by Opex Corporation of Moorestown, N.J.

The above-described extraction devices have worked well to enhance the productivity of mail room and accounting operations by expediting the processing of invoices and checks, thereby reducing the amount of time that it takes to deposit the checks into the banking system. However, there remains a desire to still further enhance the productivity and versatility of such systems.

For example, there is an ever-present impetus toward increasing the rate at which envelopes can be processed by such devices. Accordingly, while the previously mentioned Opex System 100 can process envelopes at rates approaching 10,000 envelopes per hour, and the Opex MPE 5.0 can process envelopes at rates in excess of 5,000 per hour, demands for further increases in the rate at which envelopes can be processed are anticipated.

Also to consider is that despite the significant versatility of devices such as the Opex System 100 and the Opex MPE 5.0, these devices are somewhat limited in terms of their accommodation of different types of envelopes, and different types of contents. As an example, for a particular "job" (i.e., an extraction procedure), it is generally desirable for the envelopes to be substantially uniform in terms of their characteristics, even though their contents may vary. Adjustments of the apparatus are generally necessary to handle a different type of envelope, for a different job. It is also generally desirable for the contents to be substantially uniform in terms of their characteristics. It is for this reason that steps are often taken to identify envelopes containing only an invoice and a corresponding check for its payment, and to remove envelopes containing other types of documents from further processing. An improved apparatus for the automated processing of envelopes, as well as contents, that vary in their characteristics has therefore been found to be desirable.

SUMMARY OF THE INVENTION

It is therefore a primary object of the present invention to provide an apparatus for the automated processing of bulk mail having varied characteristics.

It is also an object of the present invention to provide an apparatus for the automated processing of envelopes having varied characteristics, which can contain documents having varied characteristics.

It is also an object of the present invention to provide an apparatus for the automated processing of envelopes having varied characteristics, and containing documents having varied characteristics, without requiring any significant adjustment of the apparatus when handling such envelopes and documents from job to job.

It is also an object of the present invention to provide an apparatus for the automated processing of envelopes and documents having varied characteristics which includes envelope and document handling devices that can operate substantially independent of the characteristic features associated with the envelopes to be handled, as well as their contents.

It is also an object of the present invention to provide an apparatus for the automated processing of envelopes and documents having varied characteristics which is compatible with conventional mail room operations, including procedures subsequent to the extraction of documents from the envelopes, such as remittance processing of the extracted documents.

It is also an object of the present invention to provide an apparatus for the automated processing of envelopes and documents having varied characteristics which is straightforward in operation, and relatively simple to service and use.

These and other objects that will become apparent are achieved in accordance with the present invention by providing an apparatus for the automated processing of bulk mail which incorporates a number of operating stations that serve to accomplish the various aspects of mail extraction, as well as the subsequent processing of extracted documents, and which are operatively associated with one another to serially process envelopes and extracted documents in continuous fashion and substantially independent of their characteristic features. To this end, these operating stations are operatively associated with one another to accommodate irregularities in the envelopes (e.g., size, dimension, location of folds, manner of interconnecting the folds, windowed envelopes, windowless envelopes, etc.) and the documents that they contain (e.g., folded, connected, oversized, undersized, number, etc.), including irregularities in the orientation of the envelopes and their contents due to the random insertion of envelopes in the apparatus, as well as the random insertion of contents in the envelopes (at their source of origination).

Generally speaking, this is accomplished by an apparatus with an operative combination of processing stations including an input station for receiving a quantity of envelopes (of varying type and in random orientation) and for serially delivering the envelopes to the remainder of the apparatus, optional stations for detecting characteristic features of the envelopes and their contents, an optional station for removing selected items from further processing, a station for opening the envelopes that are to be processed, a station for extracting contents from the opened envelopes, and a series of stations for handling the contents that have been extracted. Such handling may include orientation of the contents so that documents are placed in a uniform orientation prior to their further handling, the detection of specified markings on the contents including identifying markings as well as financial information contained on the documents, stacking of the contents if such an end result is desired, or the delivery of extracted contents to associated equipment, including remittance processing equipment. These various stations are operated by a common drive system for continuously processing envelopes and their contents, as desired. However, the various stations, as well as their common drive elements, are configured to be as independent as possible of the characteristics of the envelopes and their contents so that envelopes and contents of varied characteristics can be effectively handled by the apparatus without requiring any significant adjustments. As a result, the apparatus is made capable-of processing (as a single job if desired) envelopes and contents of varied characteristics. This also significantly reduces the need to remove non-conforming envelopes and contents from the processing steps that are involved. This not only increases the versatility of the apparatus, but also tends to increase its overall productivity (operating rate).

For further detail regarding a preferred embodiment apparatus in accordance with the present invention, reference is made to the detailed description which is provided below, in conjunction with the following illustrations.

BRIEF DESCRIPTION OF THE DRAWINGS

In the several views that are provided, like reference numbers denote similar structure.

DETAILED DESCRIPTION OF PREFERRED EMBODIMENTS

Figure 1:
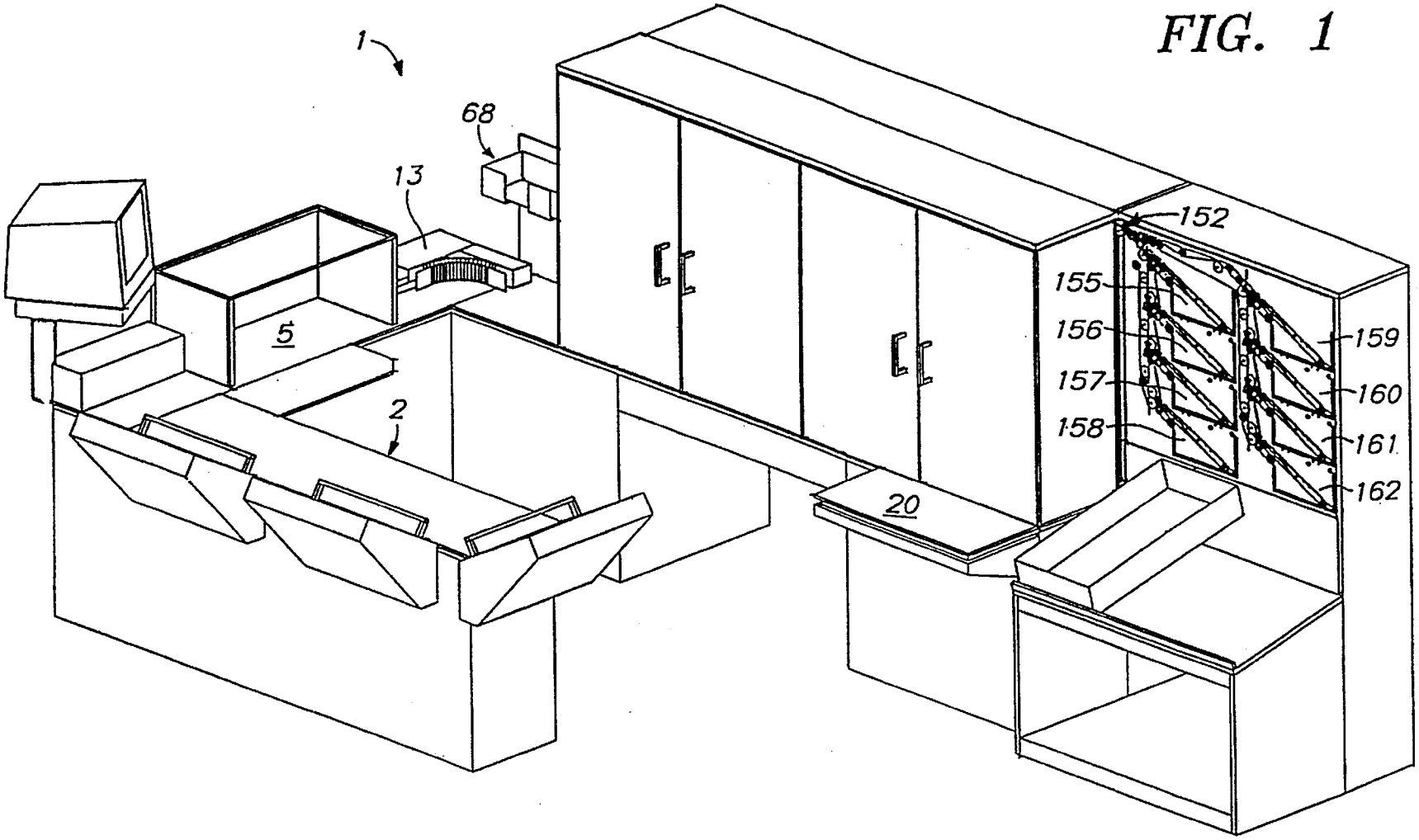
FIG. 1 is an isometric view of an apparatus for the automated processing of bulk mail in accordance with the present invention.
Figure 2:
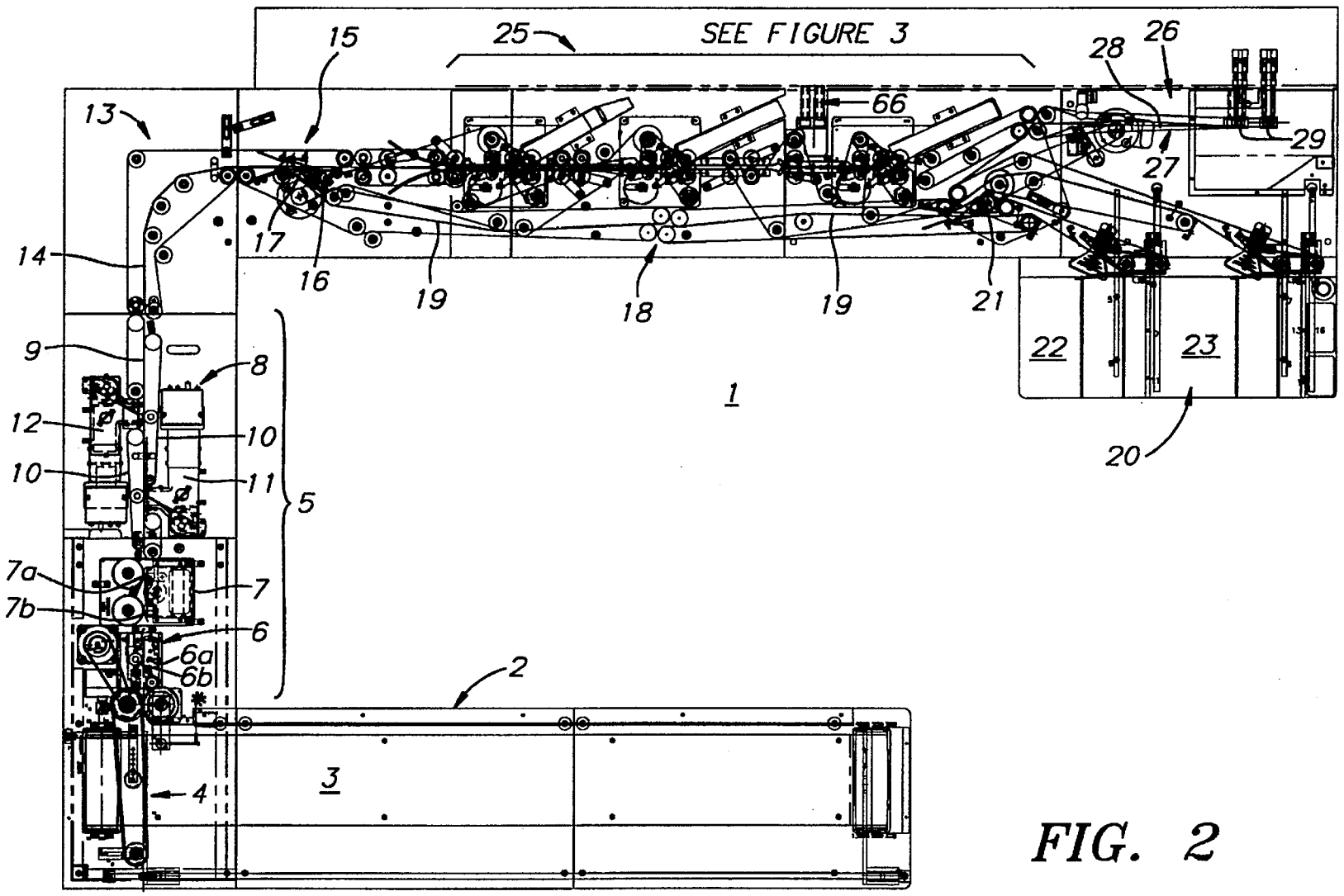
FIG. 2 is a top plan view showing portions of the apparatus of FIG. 1 that are primarily directed to receiving a quantity of envelopes, detecting characteristics associated with them, removing selected envelopes from further processing, and opening desired envelopes for further processing.
Figure 3:
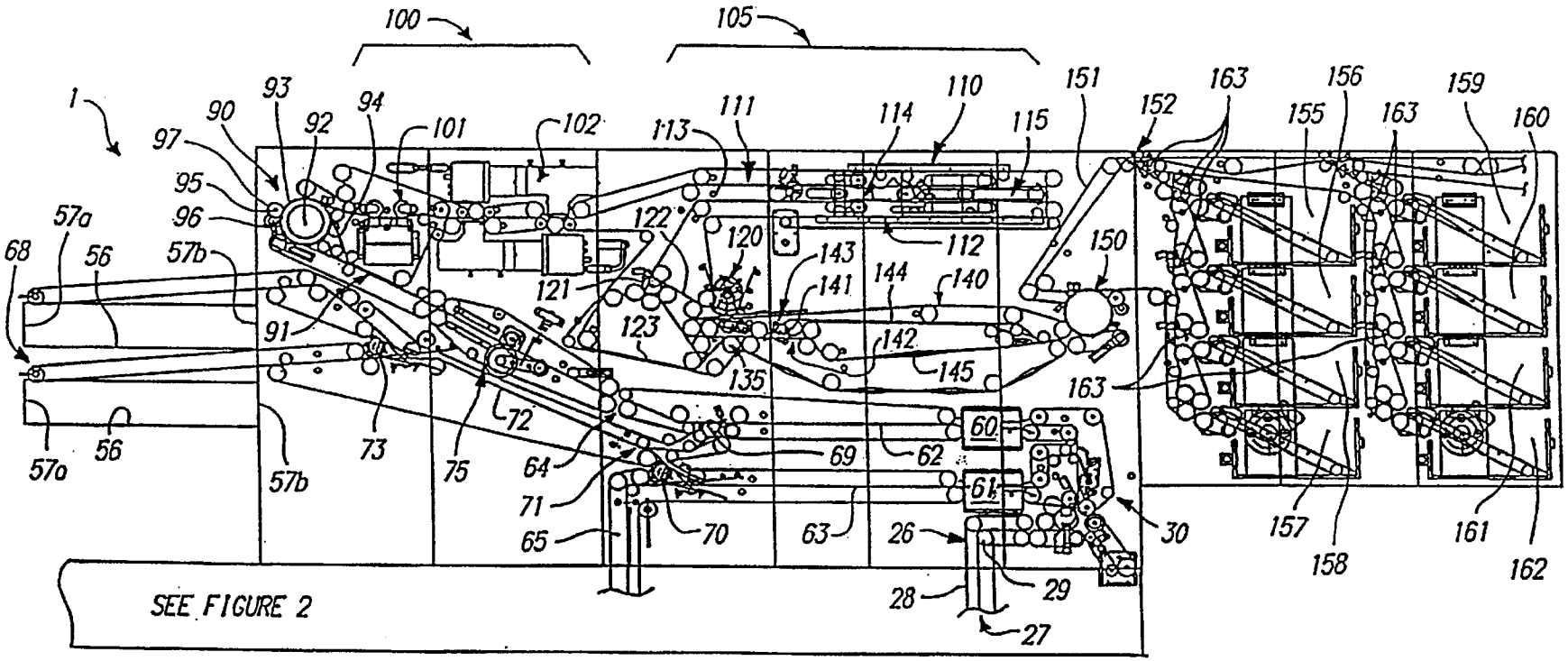
FIG. 3 is a side elevational view showing portions of the apparatus of FIG. 1 that are primarily directed to extracting contents from the envelopes that have been opened, and processing the documents that have been extracted.

FIGS. 1 to 3 collectively illustrate an apparatus 1 which is capable of receiving a quantity of envelopes containing unspecified documents, and for subjecting the envelopes and their contents to procedures that will extract documents from the envelopes, identify certain characteristic features associated with the extracted documents, and thereafter deliver the extracted documents either to a series of stacking units for receiving the documents or to a transfer unit for delivering the extracted documents to remittance processing equipment.

For purposes of the discussion which is to follow, the contents (i.e., the "documents") often referred to will be paired documents including an invoice, and a check for its payment. This is because an important purpose of the extraction apparatus 1 is to identify and handle such paired documents, to efficiently ready the accompanying checks for deposit in the banking system. However, as will be discussed more fully below, other types of documents, contained by envelopes having varied characteristics, are also effectively handled by the extraction apparatus 1. This includes contents that had previously been considered to be inappropriate for handling by automated extraction equipment (i.e., so-called "exceptional" documents). The extraction apparatus 1 further incorporates various features for facilitating its incorporation into existing mail room operations. Indeed, the overall configuration of the extraction apparatus is capable of variation to meet the needs of different mail room operations, as desired.

Generally speaking, the extraction apparatus 1 of the present invention is comprised of a series of processing stations which, if employed, can either be assembled from discrete modules, or assembled as integral units. These processing stations will be described transactionally, together with variations of these stations that can assist in meeting the varied needs of mail room operations.

Initially, an input station 2 is provided for receiving a quantity of envelopes to be operated upon by the extraction apparatus 1. The envelopes are received upon a conveyor 3, for advancement toward a feed mechanism 4 for delivering envelopes received upon the conveyor 3 to the remainder of the extraction apparatus 1. The feed mechanism 4 operates to deliver envelopes from the input station 2 both serially and one at a time. Operations of the feed mechanism 4 can proceed on a continuous basis, if desired. However, pulsed operations of the feed mechanism 4 are generally preferred since this then allows gaps between the discharged envelopes to be optimized (for downstream processing) as envelopes are delivered from the input station 2. This has been found to be advantageous for the procedures which are then to follow. The conveyor 3 is operated to provide a constant supply of envelopes to the feed mechanism 4, and to allow for convenient loading of the envelopes onto the extraction apparatus 1. Further detail regarding specifics of the input station 2 may be had with reference to U.S. patent application Ser. No. 07/887,621 and U.S. Pat. No. 4,863,037, and the input stations that they disclose.

In the configuration of FIGS. 1 to 3, envelopes are delivered from the input station 2 to a station 5 for detecting characteristic features associated with the envelopes that are received from the input station 2. Since the envelopes then enclose their contents, the characteristic features that are detected at this point will primarily relate to features of the envelopes. However, certain features associated with the contents of the envelopes can also be detected, if desired.

A thickness measuring device 6 is provided to receive envelopes and to determine their thickness, including any contents that are present, to determine certain characteristic features of each envelope and its content. Primarily, the thickness measuring device 6 is used to identify the number of documents contained by each envelope, and to identify envelopes containing items that may in some way compromise their further handling. Envelopes with desired contents would then be passed on for further processing. Envelopes containing other items would be marked (electronically tagged) for special, generally separate, handling.

For example, the thickness measuring device 6 can be used to identify envelopes containing only a single document, a pair of documents, or multiple documents (including envelopes containing letters, notes or other documents requiring special handling), as well as returned credit/debit cards. It is also possible to identify envelopes that are folded over, envelopes that include folded documents or documents that are taped together, as well as documents that are attached by staples and paper clips (although this is better detected by other devices associated with the detection station 5). To this end, the thickness measuring device 6 generally includes a fixed roller 6*a* and a movable (pivotable) roller 6*b* that are combined to form a nip for receiving envelopes so that changes in envelope thickness will cause movement of the movable roller 6*a*. A suitable electrical transducer (a linear variable differential transformer) is then used to convert such movement to electrical signals, for suitable processing to make the determinations that are desired. Further detail regarding specifics of the thickness measuring device 6 may be had with reference to U.S. Pat. No. 4,863,037, and the thickness measuring device that it discloses.

A magnetic imaging device 7 is provided to receive envelopes and to determine those that include magnetic features. This can serve to detect contents that are connected by staples, paper clips and the like, essentially performing the function of a metal detector. However, this can also serve to detect other magnetic features associated with the envelopes, if desired. For example, the magnetic imaging device 7 can be used to detect the so-called "MICR" (magnetic ink character recognition) line of a check contained within an envelope, or other magnetic indicia associated with either the check or its corresponding invoice (both of which are often printed with magnetizable ink). U.S. Pat. No. 5,240,116 discloses how a magnetic imaging device of this general type can be used to detect such features, even though enclosed by the envelope which receives them. The magnetic imaging device 7 can also be used to reliably identify envelopes containing credit/debit cards that are being returned (for various reasons), by detecting the magnetic stripe which is traditionally provided on each credit/debit card. U.S. patent application Ser. No. 07/853,411, filed Mar. 13, 1992, discloses how a magnetic imaging device of this general type can be used to detect such features.

To such ends, the magnetic imaging device 7 generally includes means (such as a magnetic head or heads 7*a*) for magnetizing magnetic ink markings on the documents, followed by means (such as a magnetic head or heads 7*b*) for detecting magnetized ink markings on the documents. Detected markings result in signals that can be stored in memory, and compared with identifiable reference standards for making the determinations that are desired. Further detail regarding specific apparatus for implementing the magnetic imaging device 7 may be had with reference to the above-mentioned U.S. Pat. No. 5,240,116 and U.S. patent application Ser. No. 07/843,411, the subject matter of which is incorporated by reference as if fully set forth herein, as well as U.S. Pat. No. 4,863,037, and the magnetic imaging devices that each discloses.

An image processing device 8 is provided to receive envelopes and to convey such envelopes along a transport path 9 defined by an opposing pair of conveyor belt systems 10 (hereafter, a "belt system" shall be taken to include a conveying medium and appropriate drums or rollers for directing that conveying medium along a desired path). The conveyor belt systems 10 operate to draw the envelopes past a pair of video camera systems 11, 12 for acquiring an image from each face of the envelope which is then progressing along the transport path 9. Apparatus for acquiring such images, and techniques for processing such images to determine characteristic features associated with the images (and accordingly, the envelope faces), is described with reference to U.S. patent application Ser. No. 07/756,930, filed Sep. 6, 1991, the subject matter of which is incorporated by reference as if fully set forth herein.

The image processing device 8 can be used to identify which of several different types of envelopes that can be handled is progressing along the transport path 9 by identifying characteristic features associated with each envelope type. Primarily, this will be done by identifying the presence or absence of a "window" (often used for purposes of revealing an address) on the front face of an envelope, and the location of flaps, folds and glued seams on the rear face of the envelope. This is done by comparing the images acquired for each envelope by the image processing device 8 with known reference images present in memory, and possessing the characteristics that are being sought, for purposes of correlation with the acquired images. Once identified by type, the envelopes can then be marked (electronically tagged) for appropriate handling by the remainder of the apparatus as will be discussed more fully below.

Generally speaking, and employing techniques that are disclosed in U.S. patent application Ser. No. 07/756,930, the image processing device 8 can also be used to identify numerous features associated with the opposing faces of each envelope as it progresses along the transport path 9. For example, the image processing device 8 can be used to identify "check boxes" that have been marked on the envelope, such as are often used to show a change of address or to call attention to specific contents within the envelope. The image processing device 8 can also be used to determine the orientation of the envelope relative to the transport path 9, should this be of interest for a particular application. The image processing device 8 can even be used to "read" information present on the envelope, including optically recognizable characters (OCR), coded information (e.g., bar-codes and the like), or even written markings.

It is also a particularly useful feature of the present invention to employ the image processing device 8 to ascertain physical features (e.g., envelope type, windowed envelopes, windowless envelopes, etc.) of the envelopes, and to use such information to ensure the effective handling of envelopes and their contents by the remainder of the apparatus, irrespective of differences in them. For example, it is not uncommon for different extracting jobs to employ different types of envelopes. By ascertaining physical features of the envelopes, it becomes possible to identify the envelope that is being handled, and the extracting job that is to take place. The envelope can then be marked (electronically tagged) in memory, so that subsequent (downstream) processing of the envelope, its contents, and the ultimate disposition for such contents, can be varied according to the mail extracting job specified for that envelope type. This could include adjustments of the downstream apparatus, as well as variation of the handling of the extracted contents following their extraction from the envelope (e.g., stacking, sorting, outsorting, stacking in a designated receiving area, delivery to a subsequent apparatus, remittance processing, etc.). This can be accomplished for envelopes of a uniform type, or in so-called "mixed jobs" (those involving mixed envelopes of varying type), in essence tailoring the downstream processing of documents to the documents that are to be received.

To be noted is that in addition to signals received from the image processing device 8, tailored downstream processing of the contents extracted from the envelopes can proceed responsive to other signals derivable from components of the detection station 5, including the thickness measuring device 6 and the magnetic imaging device 7, or from other detection devices that may be employed for such purposes, to ascertain the thickness, length, height or other optical features associated with the envelope and its contents. An example of this would be to provide the detection station 5 with an OCR reader and/or a bar-code reader (as an alternative to using the image processing device 8 for such purposes), or similar devices for detecting coded information, for reading coded information provided on the envelope or its contents (e.g., by detecting parameters associated with the contents either through the paper of the envelope, or through a window in the envelope) indicative of envelope type, extracting job, customer account information (e.g., priority payment or bank routing information), or the condition (e.g, orientation) of the envelopes and contents that are received by the extraction apparatus 1. This information can then be used to direct downstream handling of the received envelopes and their contents, as will be discussed more fully below.

In any event, the overall configuration and manner of operation of the input station 2, as well as the detection station 5, allows envelopes to be handled irrespective of differences in their overall configuration. As a result, the input station 2 and the detection station 5 can simultaneously process different types of envelopes, having different characteristics.

The detection station 5 can include some or all of the detection devices that are described above, or other types of detection devices, depending upon the features that are to be detected. Various combinations of these devices may be employed in accordance with the present invention, depending upon the application involved. Consequently, each of the several devices, including the thickness measuring device 6, the magnetic imaging device 7 and the image processing device 8, may either be included or excluded, as desired. Also to be noted is that these devices may be included in varying order, differing from the order that is shown in the illustrative apparatus of FIGS. 1 to 3. Since, as will be apparent from the description which follows, the extraction apparatus 1 of the present invention is capable of accepting and handling envelopes having varied characteristics, it becomes significantly less important to presort the envelopes prior to an extraction of their contents. It is even possible to eliminate such presorting, if desired. In such case, the detection station 5 may be omitted from the apparatus. However, for most applications, it is expected that the detection station 5 will be included as part of the extraction apparatus 1 since this tends to increase its overall versatility, as well as its productivity (operating rate).

Figure 4:
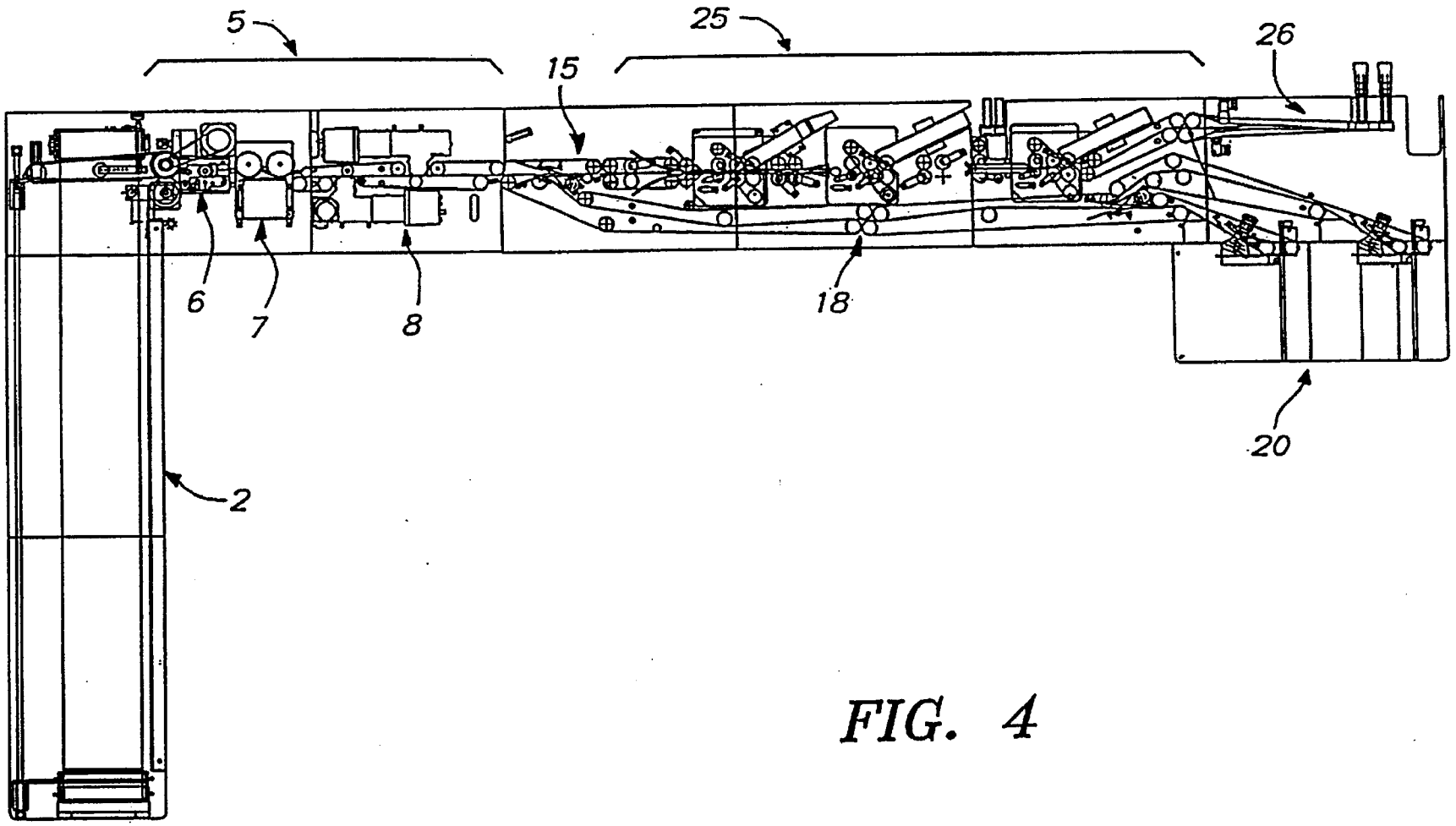
FIGS. 4 and 5 are top plan views of portions of the apparatus of FIG. 2, and alternative combinations of operating stations in accordance with the present invention.
Figure 5:
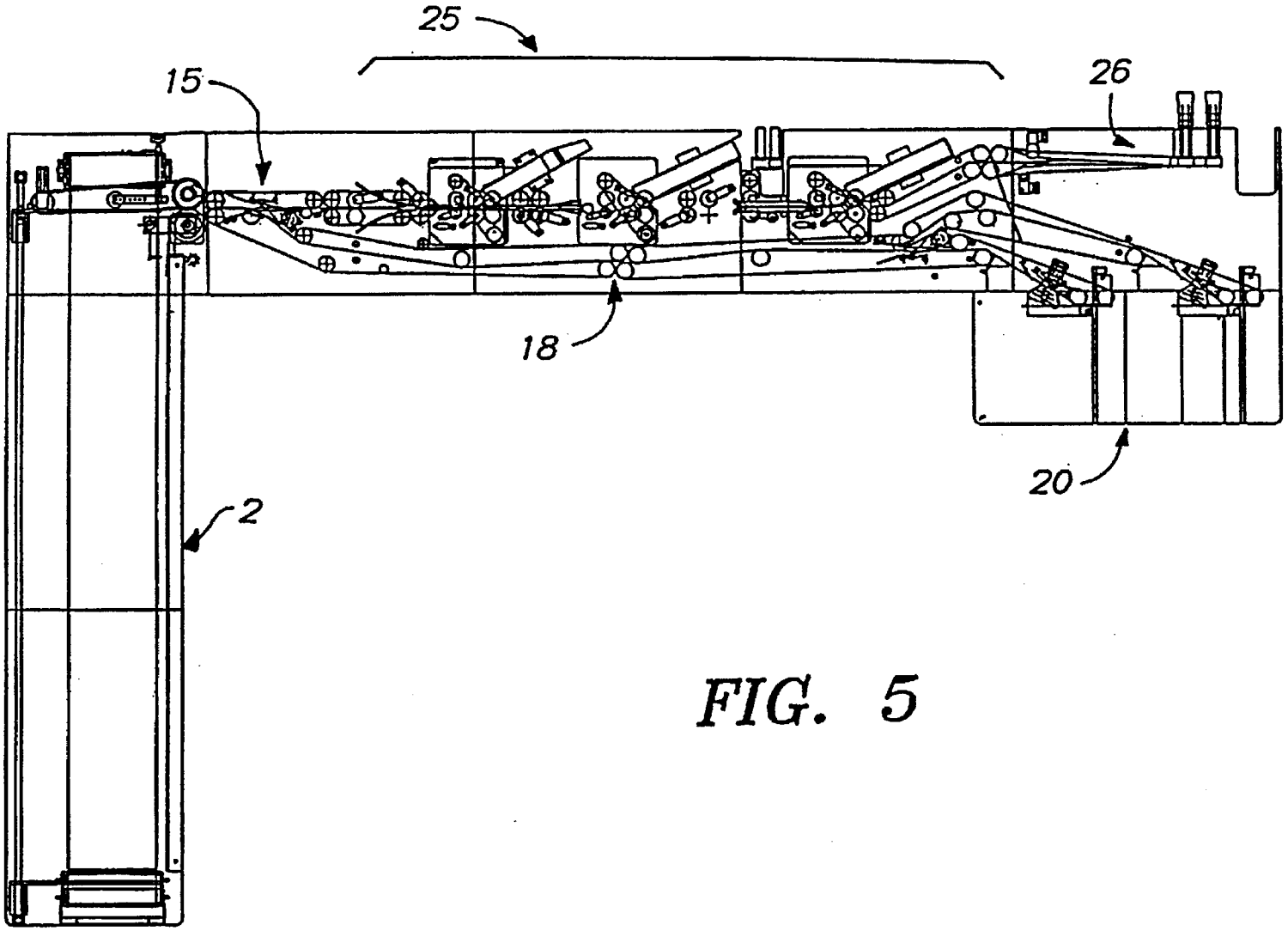

Following the detection station 5 is a turnabout section 13 that includes paired belt systems 14 for receiving envelopes from the detection station 5, for changing their direction, and for introducing the envelopes to remaining portions of the apparatus. Use of the turnabout section 13 is preferred to facilitate access to the various portions of the apparatus by an operator, but is not essential. If desired, it would also be possible to eliminate the turnabout section 13, causing the detection station 5 to communicate directly with remaining portions of the apparatus. However, this would lead to an "in-line" configuration for the overall apparatus which could be limiting in terms of space utilization and operating convenience. Such a configuration is shown in FIG. 4 of the drawings. The detection station 5 is itself an optional portion of the extraction apparatus 1. In such case, both the detection station 5 and the turnabout section 13 can be omitted from the apparatus, by placing the input station 2 immediately adjacent to remaining portions of the apparatus. Such a configuration is shown in FIG. 5 of the drawings.

As previously indicated, although the extraction apparatus 1 of the present invention is sufficiently versatile to handle envelopes of varied configuration, without a presorting operation, a presorting of envelopes remains preferred to enhance the overall productivity of the apparatus, and to identify envelopes containing documents that are best not subjected to an automated extraction procedure. Consequently, the extraction apparatus 1 will generally include a detection station 5, and a sorting (an "outsorting") of envelopes will take place. To this end, a sorting station 15 is provided to receive envelopes from the detection station 5 (and the turnabout section 13). Received envelopes are in turn introduced to a gating device 16 having a dual-position gate 17 for diverting envelopes from further processing. Envelopes diverted by the gate 17 are passed to a transport path 18 comprised of a series of belt systems 19, for delivery to a pair of stacking units 20. While it is possible to place the stacking units 20 closer to the gating device 16, use of the extended transport path 18 is preferred to place the stacking units 20 in the position shown, which is considered to be more convenient (i.e., ergonomic) for the operator. The stacking units 20 can be separately accessed responsive to a gating device 21 that selectively allows diverted envelopes to be delivered to the individual stacking units 22, 23. Further detail regarding apparatus for implementing the sorting station 15 may be had with reference to U.S. Pat. No. 5,310,062 and U.S. Pat. No. 4,863,037, and the sorting stations that they disclose.

Operations of the gating device 16 proceed responsive to signals received from the detection station 5. This would include signals received from the thickness measuring device 6, the magnetic imaging device 7 and the image processing device 8, provided these devices are employed in a particular configuration. Signals from some or all of these devices may be used to divert envelopes from further processing. These signals may be combined, if desired, to identify envelopes to be outsorted based upon detected combinations of signals. For example, the detection of credit/debit cards is made more reliable by combining signals received from the thickness measuring device 6 and the magnetic imaging device 7, as disclosed in U.S. patent application Ser. No. 07/853,411, filed Mar. 13, 1992. Other article-detecting functions are also made possible by this. Operations of the gating device 21 can proceed either responsive to signals received from the detection station 5, or based upon separately derived signals primarily intended to distribute envelopes between the stacking units 22, 23, for a balancing and/or a distribution of envelopes as outsorted envelopes are collected.

The envelopes that are not diverted from further processing by the sorting station 15 are serially delivered to a cutting station 25, which operates to open each envelope by severing at least some of its edges. Preferably, three contiguous edges of the envelope are severed, leaving the contents sandwiched between opposing faces of the envelope that are joined along a single edge. For purposes of extracting contents from their envelopes, it has generally been found to be preferable to sever the leading edge of each envelope, as well as its upper and lower edges, leaving the trailing edge of the envelope intact. While it would be possible to sever all of the edges of the envelope for other automated extraction procedures, leaving an intact trailing edge is necessary toward the extraction of contents from their envelopes as will be discussed more fully below. Further detail regarding apparatus for implementing the cutting station 25 may be had with reference to U.S. Pat. No. 4,863,037, and the cutting station that it discloses. Severed edges taken from the envelopes are collected beneath the cutting station 25, in trash bins (not shown) that are easily accessed and serviced by an operator.

The edge-severed envelopes received from the cutting station 25 are then received by a turnabout section 26. The turnabout section 26 includes paired belt systems 27 that operate to receive envelopes conveyed in an upright (generally vertical) orientation along a horizonal transport surface, and to then alter the direction of movement of the envelopes so that they proceed in a flat (generally horizonal) orientation along a vertical transport surface. Cooperating belts 28 and rollers 29 are used to cause this transition (from FIG. 2 to FIG. 3).

Use of the turnabout section 26 is again preferred and not essential. The reason for this is that remaining portions of the extraction apparatus 1 can then be deployed along a generally vertical transport section that is spatially separated from the horizonal transport section including the input station 2, the detection station 5, the sorting station 15 and the cutting station 25. This is preferred for purposes of efficiency and space utilization, as well as operator convenience in accessing the various portions of the apparatus that need to be serviced by an operator. However, the turnabout section 26 could be deleted, if desired, leaving remaining portions of the apparatus to be implemented in a substantially horizonal orientation.

Figure 6:
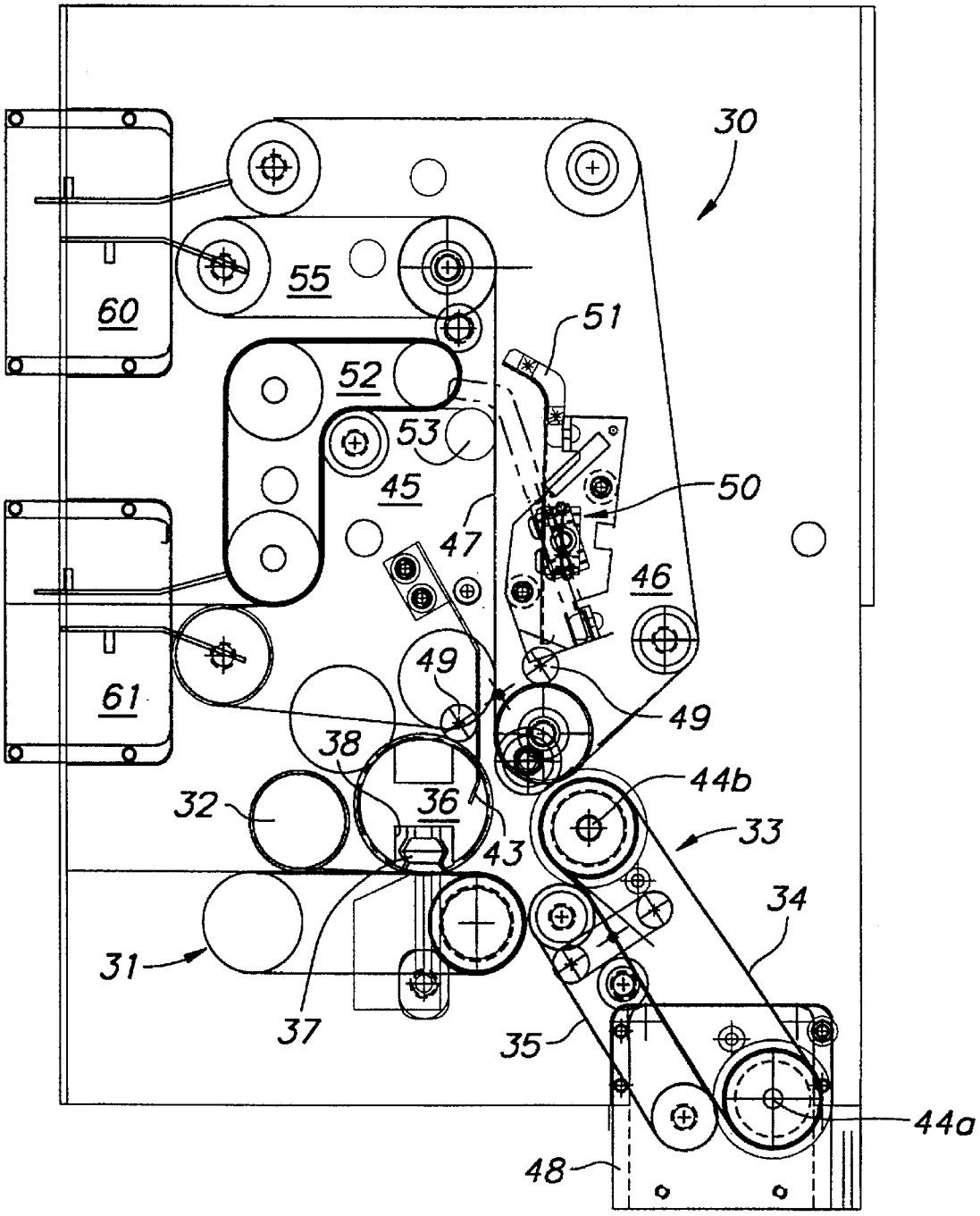
FIG. 6 is an enlarged elevational view of portions of the apparatus of FIG. 3 that are employed to extract documents from their envelopes.
Figure 7A:
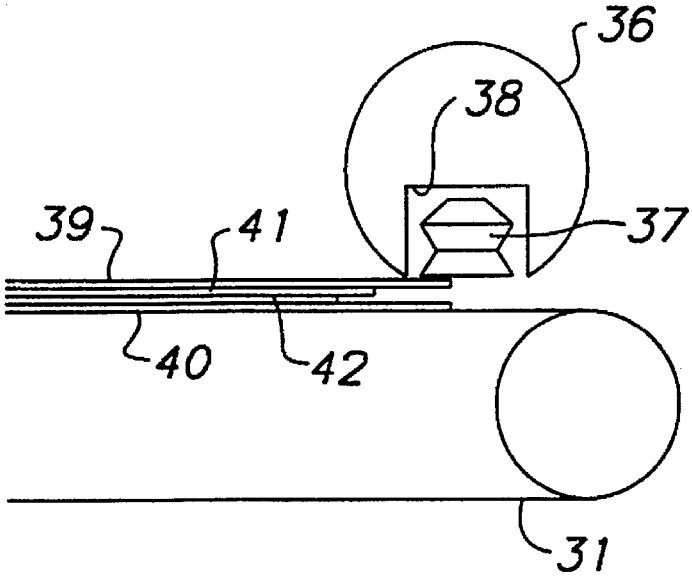
FIGS. 7A to 7E are sequential schematic illustrations of an envelope (with contents) passing through the extraction apparatus of FIG. 6.

Referring now to FIG. 6, envelopes received from the turnabout section 26 are introduced to an extraction station 30. To this end, the turnabout section 26 communicates with a belt system 31 and a roller 32 that combine to receive the edge-severed envelopes, and to direct them toward a receiver 33 defined by a cooperating pair of belt systems 34, 35. As each envelope is passed from the roller 32 to the receiver 33, a face of the envelope is caused to pass a drum 36 (see FIG. 7A). The drum 36 incorporates a suction cup 37 housed Within a recess 38 formed in the drum 36. A vacuum is applied at the suction cup 37, to entrain the adjacent envelope face and to draw the engaged envelope face toward the suction cup 37 (and the drum 36). The suction cup 37 is a "collapsible" suction cup such as is disclosed in U.S. Pat. No. 5,052,168. As a result of this, the adjacent envelope face is drawn toward the suction cup 37, covering the suction cup 37 and causing the suction cup 37 to collapse (into the recess 38) and seal off the vacuum. This serves to entrain the envelope face and to retain the entrained envelope face to the drum 36, while minimizing the potential for "bleed through" that could possibly also entrain contents of the envelope. Further detail regarding the manner in which the drum 36 and the suction cup 37 operate to effectively entrain an envelope face and draw that envelope face away from the contents of the envelope may be had with reference to U.S. Pat. No. 5,310,062, and the extraction station that it discloses. However, it is important to note here that unlike the extraction station described in U.S. Pat. No. 5,310,062, the extraction station 30 employs only one suction cup 37 to engage a single envelope face. This tends to significantly reduce the probability that contents will be entrained with the withdrawn envelope face, since only one envelope face is being operated upon. If desired, further assurances against entraining contents with the withdrawn envelope face can be achieved by corrugating documents in the vicinity of the drum 36, or by placing opposing vacuum or air jets in the vicinity of the drum 36.

Figure 7B:
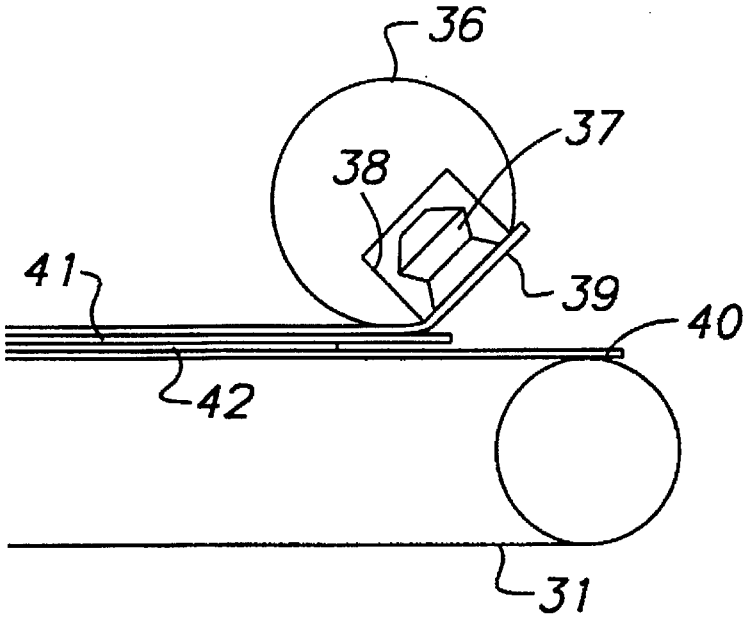

In any event, and referring now to FIG. 7B, this will cause one of the envelope faces (the face 39) to be drawn away from the remaining envelope face (the face 40) and the contents of the envelope. For purposes of the discussion which is to follow, it will be assumed that the envelope contains a pair of documents 41, 42. However, this is not essential to operations of the extraction station 30. Rather, the extraction station 30 is configured to handle contents of varying characteristics, including single documents, multiple documents, folded documents, or other contents potentially associated with the envelopes. All such contents would be handled by the extraction station 30 in substantially equivalent manner, as follows.

Figure 7C:
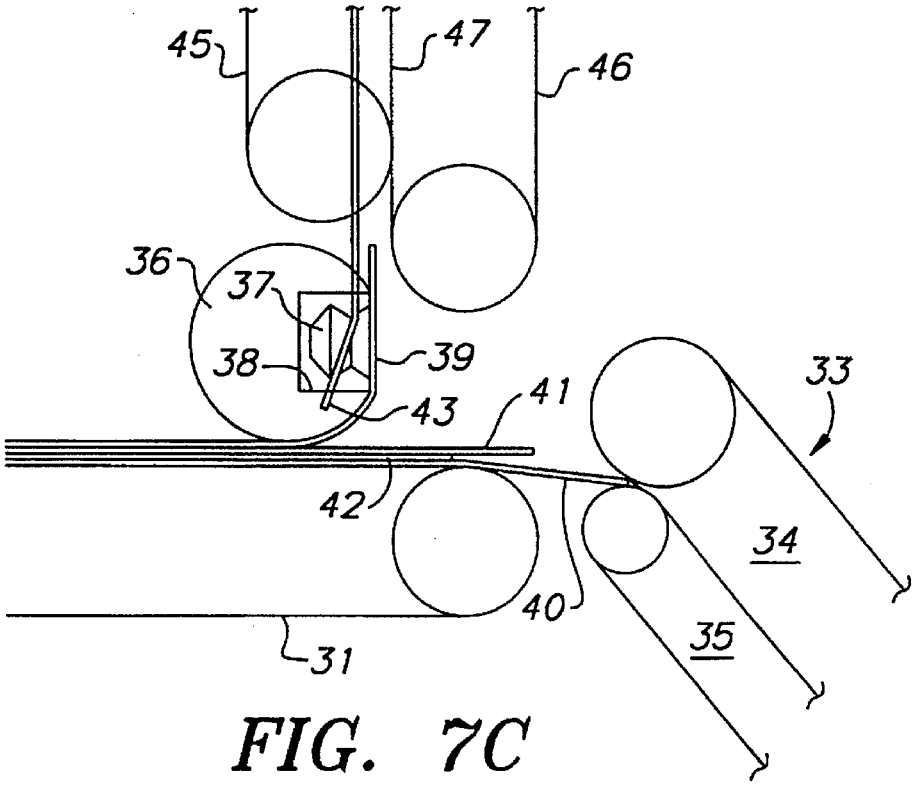

Referring now to FIG. 7C, with the assistance of a guide 43, the face 39 of the envelope that is entrained by the drum 36 is then directed toward a pair of belt systems 45, 46. The belt systems 45, 46 serve to engage the envelope face 39 and cause it to progress along a transport path 47, away from the drum 36. The remaining face 40 and the contents 41, 42 will continue to proceed in their original direction, entering the receiver 33. As this occurs, the belt systems 34, 35 of the receiver 33 will be operating in a direction suitable for receiving the envelope face 40 and the contents 41, 42 (which would then be progressing downwardly and toward the right in FIG. 6). This is advantageously accomplished by combining an active belt system 34, which is operated responsive to a motor 48, with a passive belt system 35 that operates responsive to movements of the belt system 34.

Figure 7E:
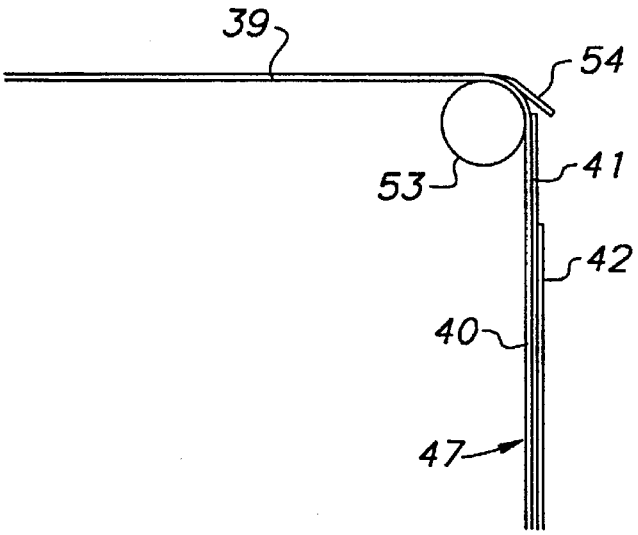
Figure 7D:
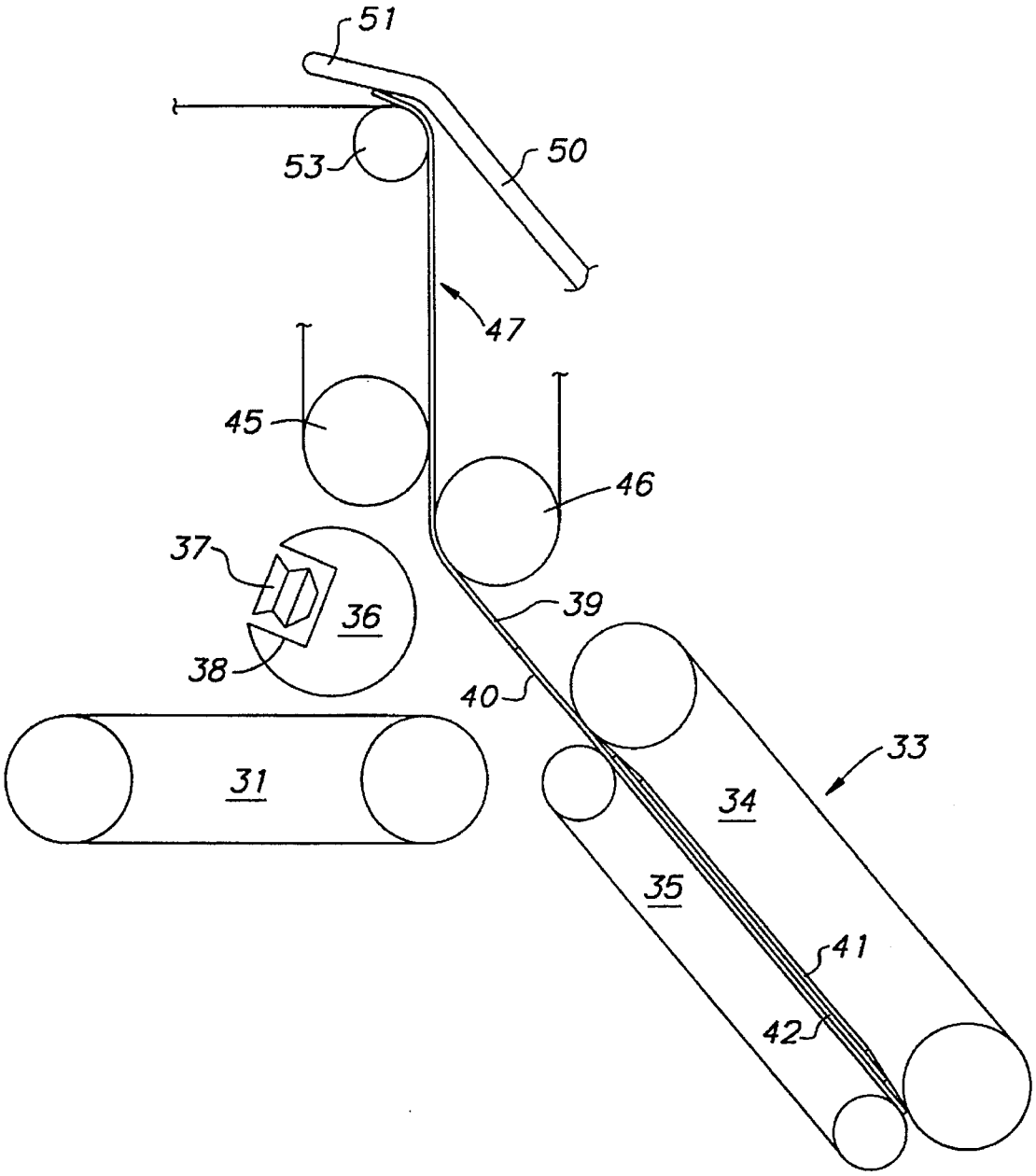

Referring now to FIG. 7D, the envelope face 39 will be drawn along the transport path 47 and the envelope face 40 (together with the contents 41, 42) will be collected within the receiver 33. The remaining, intact envelope edge will eventually pass from between the drum 36 and the belt system 31, maintaining a connection between the envelope face 39 and the envelope face 40. At this point, steps must be taken to reverse the belt systems 34, 35 so that the envelope face 40 and the contents 41, 42 can pass from the receiver 33 to the transport path 47 (following the envelope face 39). Reversal of the belt systems 34, 35 can be accomplished by reversing rotation of the motor 48 (e.g., a stepper motor). However, reversal of the belt systems 34, 35 is preferably accomplished by providing the belt system 34 with mated clutches 44*a*, 44*b*, and by selectively operating the clutches 44*a*, 44*b* to reverse the associated belt system 34. In operation, the clutch 44*a* is initially activated to draw articles into the receiver 33. At a specified time following detection of the passage of the envelope face 40 and the contents 41, 42 into the receiver 33 (detectable, for example, by an upstream sensor positioned to detect the trailing edge of the envelope being operated upon), the clutch 44*a* is deactivated and the clutch 44*b* is activated, reversing the direction of the belt system 34 so that articles are delivered from the receiver 33.

In any event, as the joined envelope faces 39, 40 are pulled taught, the belt systems 34, 35 will be reversed, allowing the envelope face 40 and the contents 41, 42 to pass from between the belt systems 34, 35, as desired. By adding a slight delay to reversal of the belt systems 34, 35, a rearward shifting of the contents 41, 42 becomes possible. This will assist in withdrawing the contents 41, 42 from beneath any glue flaps associated with the envelope faces 39, 40, as will be discussed more fully below. Reversal of the belt systems 34, 35 can also be timed responsive to appropriate sensors (e.g., a photodetector) placed along the transfer path 47, or elsewhere in the extraction station 30, if desired.

A sensor 49 (e.g., a photodetector) is provided along the transport path 47 to detect the leading edge of the face 39 as it progresses along the transport path 47. If desired, the sensor 49 could be used to control rotation of the motor 48, and operation of the belt systems 34, 35, as previously described. However, signals received from the sensor 49 are primarily used to toggle a solenoid-operated deflector 50, causing the curved tip 51 of the deflector 50 to overly the transport path 47 as shown in phantom in FIG. 6. This, in turn, engages the leading edge of the envelope face 39, deflecting the envelope face 39 between the belt system 45 and a cooperating belt system 52.

In doing so, and referring now to FIG. 7E, the engaged face 39 of the envelope is caused to progress around a roller 53 of relatively small diameter. This is done to, in essence, "peel back" the envelope face 39 as it passes over the roller 53. Passing the face 39 of the envelope around a roller 53 of relatively small diameter has been found to significantly improve the reliability of separating the envelope face 39, as well as the connected envelope face 40, from the contents 41, 42. It has been found that in extracting contents from an envelope, it is not uncommon for one or more of the contents to be entrained by the flaps forming the envelope, essentially trapping such contents within the envelope and preventing their separation from it. By causing the envelope faces 39, 40 to pass around a roller 53 of relatively small diameter, flaps associated with the envelope faces (e.g., the flap 54 shown in FIG. 7E) are peeled away from the adjacent envelope face (e.g., the envelope face 40 shown in FIG. 7E), releasing any potentially entrapped contents from between the flap 54 and the envelope face 40.

Following an amount of time which is sufficient to ensure that the leading edge of the envelope face 39 is engaged by the tip 51 of the deflector 50, and is received between the cooperating belt systems 45, 52, the deflector 50 is released and returned to a static position which no longer interacts with the envelope's faces or its contents. This amount of time is advantageously established either as a set delay time, following activation of the deflector 50, or responsive to an appropriately located sensor. As a result, the envelope face 39, and in turn the envelope face 40, are drawn between the cooperating belt systems 45, 52. However, the contents 41, 42 are allowed to continue along the transport path 47, effectively extracting the contents 41, 42 from their associated envelope.

The contents 41, 42 are passed from the cooperating belt systems 46, 55 that receive them to a thickness measuring device 60, and the envelope faces 39, 40 are passed from the cooperating belt systems 45, 52 to a thickness measuring device 61. The thickness measuring devices 60, 61 correspond structurally to the thickness measuring device 6 of the detection station 5, and are used to verify that all contents have been extracted from their envelope (the thickness measuring device 60) and that no contents remain with the separated envelope faces (the thickness measuring device 61). Further detail regarding the manner in which such determinations can be made may be had with reference to U.S. Pat. No. 4,863,037, and the extraction station that it describes.

Referring again to FIG. 3, cooperating belt systems 62 communicate with the thickness measuring device 60 to receive the extracted contents 41, 42, and cooperating belt systems 62 communicate with the thickness measuring device 61 to receive the envelope faces 39, 40. Assuming it is determined (by the thickness measuring devices 60, 61) that an effective extraction has taken place, the contents 41, 42 of the envelope will proceed along the cooperating belt systems 62, toward a delivery point 64. The envelope faces 39, 40 will proceed along the cooperating belt systems 63, entering a turnabout section 65. The turnabout section 65 operates to direct the envelope faces 39, 40 toward the horizontal transport surface associated with the cutting station 25. As seen in FIG. 2, the resulting transport path terminates at 66, passing the envelope faces 39, 40 to the trash bins (not shown) that are positioned beneath the cutting station 25. In addition to providing an efficient means for disposing of the envelope faces 39, 40, it has been found that because the weight of the envelope faces significantly exceeds that of the severed envelope edges that are already present in the trash bins (resulting from operations of the cutting station 25), the discarded envelope faces are useful in compacting the slivers represented by the severed envelope edges. This has been found to enhance the overall efficiency of the trash bins, extending the amount of time required before they must be emptied.

In the event it is determined (by the thickness measuring devices 60, 61) that an effective extraction has not taken place, steps are preferably taken to reunite the contents 41, 42 and their corresponding envelope faces 39, 40, and to deliver the reunited envelope and contents to outsort bins 68. This would occur, for example, in situations where the thickness measuring device 60 detects other than two documents passing through it, or in situations where the thickness measuring device 61 detects more than one document thickness (i.e., an envelope face) passing through it. Contents and envelope faces are reunited by gating devices 69, 70 associated with the belt systems 62, 63, respectively. If it is determined that an effective extraction has not taken place, the gating devices 69, 70 are both activated and extended into the transport paths defined by the belt systems 62, 63. As a result, contents passing along the belt systems 62 are diverted by the gating device 69, and envelope faces (and potentially, contents) are diverted by the gating device 70. Such contents and envelope faces are then merged, at 71, and passed along cooperating belt systems 72. If desired, the cooperating belt systems 72 can communicate directly with a single outsort bin for receiving reunited envelope faces and contents as they are passed from the extraction station 30. In the alternative, and as is shown in FIG. 3, the cooperating belt systems 72 can advantageously communicate with a gating device 73 for distributing reunited envelope faces and contents between plural outsort bins 68. Such distribution can proceed either according to detected characteristics associated with the reunited envelope faces or the contents, or to one of the outsort bins as the other is being emptied (so that the operator need not interact with an outsort bin that is in the process of receiving reunited envelope faces or contents).

Figure 8:
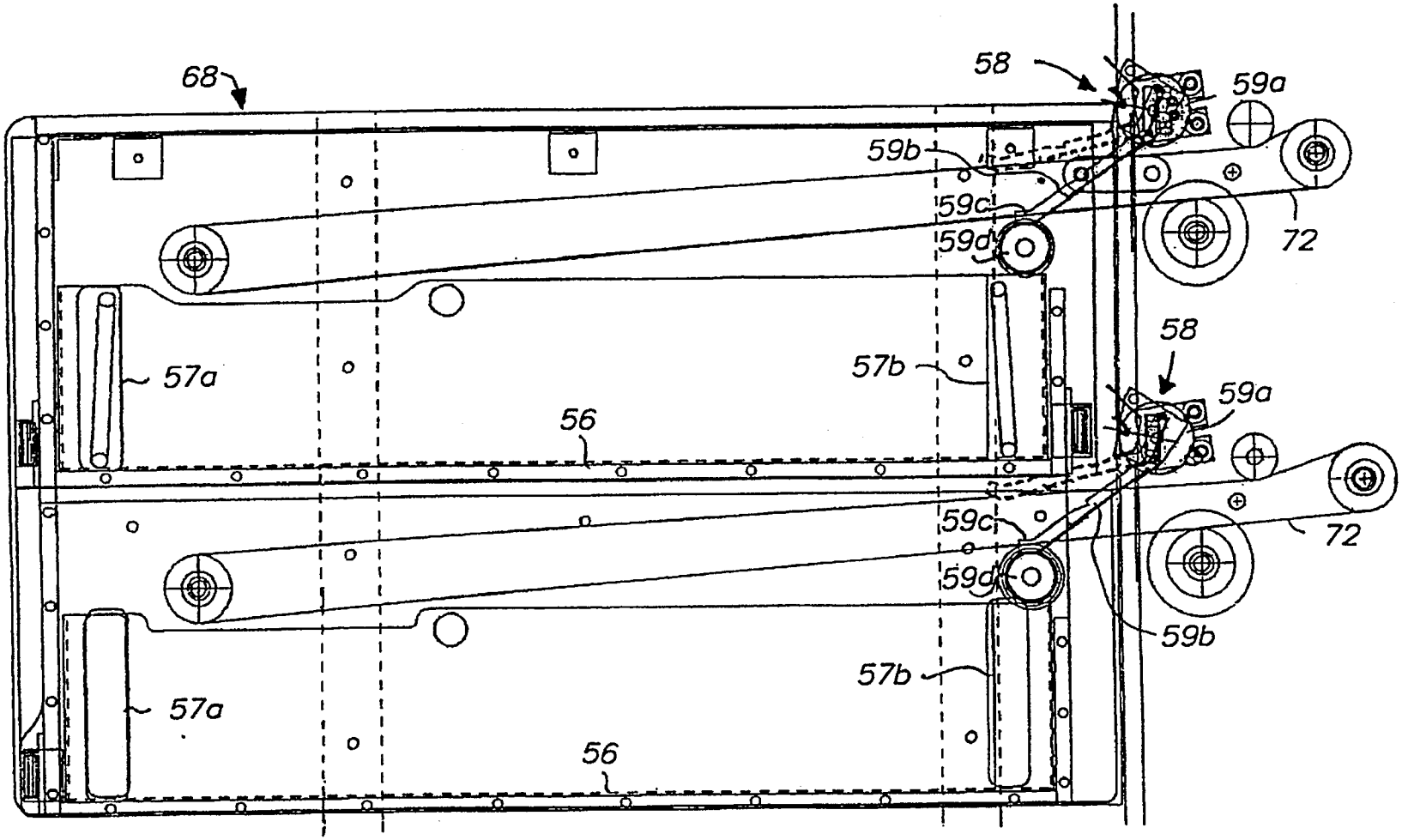
FIG. 8 is an enlarged elevational view of an alternative embodiment apparatus for receiving and stacking envelope faces and contents that have been diverted from further processing following their handling by the extraction apparatus of FIG. 6.

The outsort bins 68 of FIG. 3 are configured to freely receive reunited envelope faces and contents from the cooperating belt systems 72, so that they rest upon a floor 56 and between opposing walls 57*a*, 57*b*. Resulting from the relatively high transport speeds allowed by operations of the extraction apparatus 1, the potential exists for the leading edge of an envelope face to strike the wall 57*a* with sufficient force to cause that envelope face to curl or fold over the other envelope face, and the associated contents, or to undesirably shift the contents along the envelope faces. To prevent this from occurring, and referring to FIG. 8, the outsort bins 68 are advantageously provided with a retarding device 58 capable of interacting with the reunited envelope faces and contents received from the cooperating belt systems 72, and for slowing the received envelope faces and contents for a more orderly placement within the outsort bins 68 (e.g., right justified to the wall 57*b*). To this end, a solenoid 59*a* (or equivalent drive mechanism) receives an arm 59*b* capable of extending from a retracted position (shown in phantom) to a position which overlies envelope faces and contents received from the cooperating belt systems 72. The arm 59*b* terminates in a tip 59*c* for interacting with a roller 59*d* which is slightly offset from the transport path normally established for the envelope faces and documents to be received by the outsort bins 68, and which rotates at a rate that is reduced from the rate established for the remainder of the extraction apparatus 1. Responsive to the passage of a leading or trailing paper edge (detectable by appropriately positioned sensors), the solenoid 59*a* is activated so that the tip 59*c* of the arm 59*b* is brought into contact with the roller 59*d*. As a result, received envelope faces and contents are caught between the tip 59*b* and the roller 59*d*, slowing the envelope faces and contents and directing them toward the outsort bins 68. The retarded envelope faces and contents are then passed from between the arm 59*b* and the roller 59*d*, dropping to the floor 56 in an orderly fashion that prevents undesirable bending, curling or shifting, as is desired.

Although use of the extraction station 30 is preferred because of its versatility and simplicity, it is also possible to employ other extraction devices for similar purposes, such as the extraction devices that are disclosed in U.S. Pat. No. 5,310,062 and U.S. Pat. No. 4,863,037. However, it is important to note that the extraction station 30 is substantially independent of the characteristic features associated with the envelopes that are to be processed (the envelope faces) and the contents which they contain.

Clearly, this allows the often-preferred combinations of invoices and checks, together with the associated envelope faces, to be efficiently handled by the extraction station 30. What is more, this is accomplished in substantially continuous fashion, with minimal gating, and with a substantially longitudinal flow (with only one reversal of direction, the receiver 33). This serves to enhance not only the rate at which envelopes can be processed, but also the reliability of the overall system.

However, this also allows the extraction station 30 to handle envelopes and contents that had previously been considered as exceptional, and not appropriately subjected to an extraction procedure. This would include contents such as document pairs that are taped, stapled or paper clipped, folded documents, single documents and multiple documents. This would also include nonconforming envelope features, as well as the accommodation of so-called "bang-tail" envelopes (those including extra flaps for mail-order purposes). Taped, stapled or paper clipped documents can be identified by the thickness measuring devices 60, 61, signifying connected document pairs. Folded documents, single documents, or multiple documents can also be identified by the thickness measuring devices 60, 61. Responsive to this, or to signals received from the detection station 5, both effective and ineffective extractions can be identified. Indeed, since the detection station 5 can identify envelopes and their contents by type (i.e., job), this information can be used to establish the parameters for the thickness measuring devices 60, 61. This allows so-called mixed jobs to be effectively handled by the extraction apparatus 1, as well as a verification of the contents that have been extracted from a particular envelope (by checking the extracted documents with those anticipated for a given extraction procedure).

In any event, all extractions from envelopes can proceed as previously described, whether the contents are paired or otherwise. Desired documents identified by the thickness measuring devices 60, 61 as being effectively extracted from their envelopes would then be passed to the delivery point 64, as previously described, and through remaining portions of the extraction apparatus 1. This is made possible because all remaining portions of the extraction apparatus 1 include some facility for effectively passing documents through them, irrespective of the characteristic features of such documents. In such case, the resulting documents can be stacked following their discharge from the extraction apparatus 1, as will be discussed more fully below. However, this may at times be less preferred since this can tend to introduce a limited potential for jamming of the apparatus, in attempting to handle certain types of non-conforming documents. The removal of non-conforming documents from further processing, by passing them to the outsort bins 68, will generally be preferred in such cases.

In the alternative, selected documents can be removed from further processing immediately following their extraction. This is readily accomplished by the gating devices 69, 70. To this end, the gating device 69 can be activated to divert selected documents from the belt systems 62, for delivery to the outsort bins 68. These selected documents are then preferably introduced to one of the outsort bins 68, leaving the other (or any remaining) outsort bin to receive reunited, ineffectively extracted documents and envelope faces. This is advantageously accomplished using the gating device 73. The selected documents would then be extracted from their envelopes, facilitating their subsequent handling (opening of the associated envelope will have already been accomplished). The gating device 70 can be used to divert the associated envelope faces from the belt systems 63, for delivery to the outsort bins 68 together with the selected documents, if desired. However, it is also possible to allow the envelope faces to pass the gating device 70, for transport along the turnabout section 65 and to the termination 66, for discard. Again, this would leave extracted documents for convenient processing separate from the extraction apparatus 1.

Documents discharged from the extraction station 30, at the delivery point 64, are then introduced to a separation station 75. The separation station 75 primarily operates to receive paired, parallel documents and to separate them so that they are serially delivered from the separation station 75, one at a time. Similar techniques can be employed to separate multiple documents, if desired. Single documents or connected documents (paired or multiple) are preferably passed through the separation station 75 without being operated upon.

Figure 9:
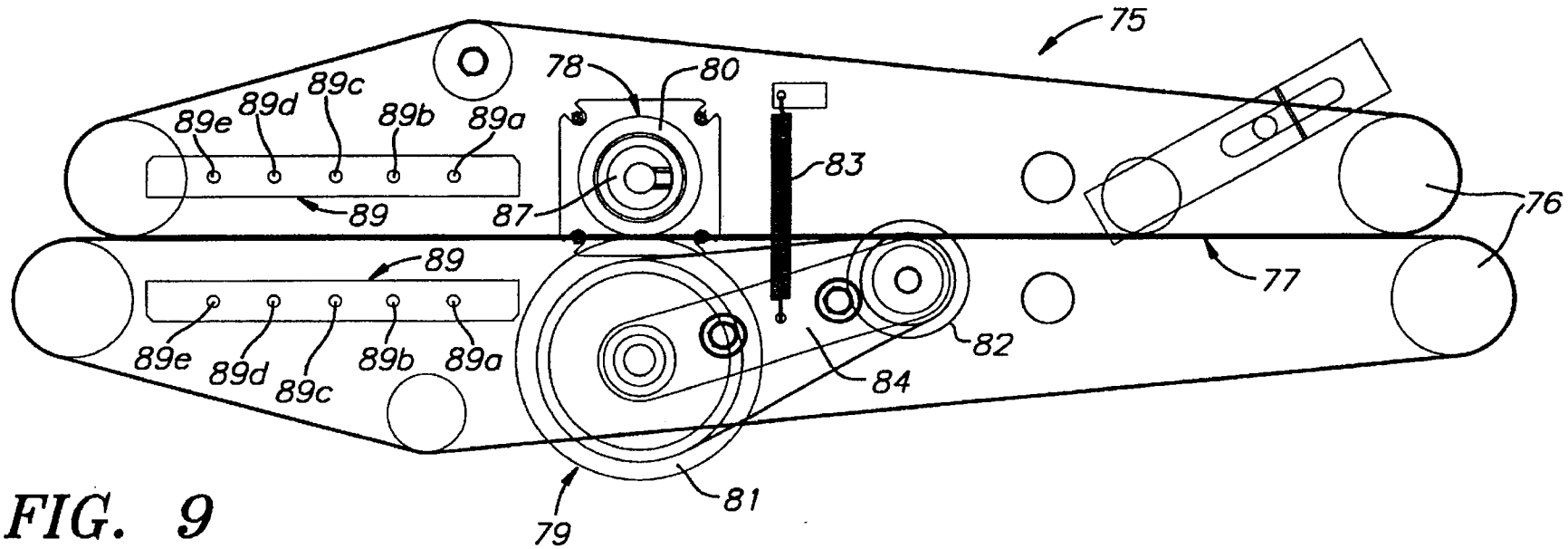
FIG. 9 is an enlarged elevational view of portions of the apparatus of FIG. 3 that are employed to separate paired, parallel documents for serial discharge.

To this end, and referred now to FIG. 9, the separation station 75 includes paired belt systems 76 for defining a transport path 77 for documents passing through the separation station 75. The paired belt systems 76 communicate with the delivery point 64 of the extraction station 30, to receive extracted documents for transport along the path 77. Substantially midway along the transport path 77 is a pair of rollers 78, 79. The roller 78 is an idler roller with an outer surface 80 formed of a material having a relatively high coefficient of friction. The roller 79 is an active (driven) roller with an outer surface 81 formed of a material having an intermediate coefficient of friction, between the coefficient of friction established between the paper of the document pairs and the coefficient of friction of the surface 80 of the idler roller 78. The active roller 79 is rotated responsive to a drive element 82 (either a motor or a power take-off), and is mounted on a spring-loaded (spring 83) pivotable arm 84. The spring 83 and the pivotable arm 84 permit controlled separation of the rollers 78, 79 as paired documents are received between them. The spring 83 also provides for self-adjustment of the active roller 79 relative to the fixed roller 78, and the transport path 77, since the surfaces 80, 81 are subject to wear.

In operation, the rollers 78, 79 are placed in contact with one another so that the idler roller 78 is operated responsive to rotations of the active roller 79. As paired documents are drawn along the transport path 77, the rollers 78, 79 separate under the influence of the spring 83 and the pivotable arm 84, allowing the documents to pass between the rollers 78, 79. The idler roller 78 is provided with a braking mechanism 87 that can be selectively operated to cease rotation of the idler roller 78. Such braking of the idler roller 78 will cause the surface 80 (having a relatively high coefficient of friction) to frictionally engage the immediately adjacent document of the document pair. The remaining document of the document pair will be engaged by the surface 81 of the roller 79, which continues to rotate. Since a relatively low coefficient of friction is developed between the documents of the document pair, the document engaged by the roller 79 will be urged forward relative to the document engaged by the roller 78, continuing (without hesitation) along the transport path 77 and exiting from between the rollers 78, 79. Since the surface 80 has a coefficient of friction higher than the coefficient of friction of the surface 81, this condition will continue until the braking mechanism 87 is released. Following this, the remaining document is passed from between the rollers 78, 79, completing the separation (so-called singulation) of documents for serial processing as will be discussed more fully below.

Figure 10:
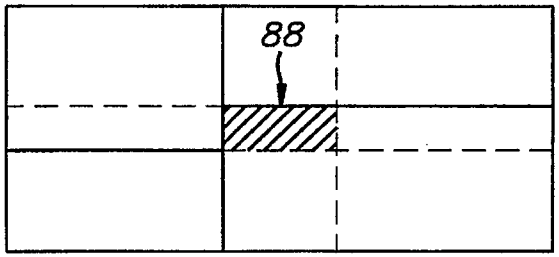
FIG. 10 is a schematic view of theoretical documents, showing the selection of a "sweet spot" for purposes of engaging the documents in a manner that will ensure their effective separation.

To ensure an effective separation of documents irrespective of their size, the rollers 78, 79 are preferably of a size, and positioned relative to the transport path 77 so that all possible documents will be effectively engaged as previously described. Referring to FIG. 10, this is accomplished by positioning the rollers 78, 79 so that they contact the document pairs at a "sweet spot" 88 selected to account for variations in the documents that are to be processed. The sweet spot 88 is empirically determined, and is primarily dependent upon the size of the largest anticipated envelope and the size of the smallest anticipated document. For example, and referring to FIG. 10, an exemplary envelope of maximum anticipated size is shown with documents of minimum anticipated size, shifted to the four extreme positions that such documents could assume. This leaves a common area (i.e., the sweet spot 88) where all documents must pass. The rollers 78, 79 are then placed at this location, to ensure that all documents are effectively engaged by them.

Proper positioning of the documents relative to the transport surface (for engagement at the sweet spot 88) will be accommodated by mechanical considerations such as the height of the rollers 78, 79 relative to the transport surface. However, proper positioning of the documents along the transport path 77 will be determined by timing considerations including activation of the braking mechanism 87, to cease rotation of the idler roller 78, and release of the braking mechanism 87, to allow continued rotation of the idler roller 78. Such timing considerations are also important in establishing appropriate gaps between the documents (of a document pair, and between respective document pairs) as they are serially passed from the separation station 75.

Timing for operations of the braking mechanism 87, and accordingly, for operation of the separation station 75, is preferably derived responsive to signals received from an array of sensors 89 (the sensors 89*a*, 89*b*, 89*c*, 89*d*, 89*e*) placed at spaced locations along the transport path 77, following the rollers 78, 79. Alternatively, timing for operations of the braking mechanism 87 is derivable from sensors positioned in advance of the rollers 78, 79. In any event, timing derived from the array of sensors 89 (or otherwise) will depend upon the manner in which documents are to be separated, which can be varied in accordance with the present invention.

For example, for purposes of simplicity, it is presently preferred to separate the paired, parallel documents so that one of the documents leads the other without regard to which of the two documents constitutes the leading one. To accomplish this, movement of the paired, parallel documents between the rollers 78, 79 is determined responsive to the passage of a leading edge (of one of the two documents) past one of the sensors (e.g. the sensor 89*a*) of the array. The resulting signal is used to operate the braking mechanism 87, braking the roller 78 at a point in time when the paired, parallel documents are located between the rollers 78, 79 (at the sweet spot 88). The difference in friction between the surface 80 (relatively high coefficient of friction) of the roller 78 and the surface 81 (intermediate coefficient of friction) of the roller 79, relative to the friction developed between the two sheets of paper then comprising the paired documents, will cause the document adjacent to the active roller 79 to proceed along the transport path 77, while holding back the document adjacent to the braked idler roller 78. Movement of the leading document past the array of sensors 89 is then used to time the release of the braking mechanism 87, allowing the second document to pass from between the rollers 78, 79 at a specified time after the first document has done so.

It has generally been found to be desirable to establish a gap between the documents that are discharged from the separation station 75, so that the documents are thereafter more effectively handled. This is advantageously accomplished by timed activation and deactivation of the braking mechanism 87. It is preferable to establish a gap between the two documents that is consistent (i.e., consistent pitch) from the leading edge of the leading document to the leading edge of the trailing document. However, the manner in which the paired, parallel documents are received between the rollers 78, 79 will necessarily vary. Resulting from variations in document length, and the manner in which the documents are extracted from their envelopes, either of the paired, parallel documents may lead the other to some extent. For this reason, the last of the sensors (the sensor 89*e*) in the array of sensors 89 is preferably used to detect the leading edge of the leading document as the leading document passes from between the rollers 78, 79. This is because the sensor 89*e* should in all cases be clear of the document (the trailing document) held back by the braked roller 78, and available to detect the leading edge of the document (the leading document) which is being urged forward by the active roller 79, as is desired. As the leading document is withdrawn from between the rollers 78, 79, some of the sensors in the array of sensors 89 will remain covered by the trailing document (then retained between the rollers 78, 79), while other sensors will be clear. Identification of the first cleared sensor (or the last covered sensor) then operates to locate the leading edge of the trailing document, within the resolution of the array (resulting from the spacing between the sensors 89*a*, 89*b*, 89*c*, 89*d*, 89*e*). By comparing this with the location determined for the leading edge of the leading document, timed release of the braking mechanism 87 can effectively operate to regulate the gap left between the leading document of the document pair, and the trailing document of the document pair. The number of sensors associated with the array of sensors 89 can be varied, as desired, to vary the resolution of the determinations that are made, and the gaps between documents that result.

As an alternative for determining spacing between the documents delivered from the separation station 75, the above described operations of the array of sensors 89 can be replaced by operations responsive to signals derived from the thickness measuring device 60 of the extraction station 30. Resulting from thickness measurements taken as the paired, parallel documents pass through the thickness measuring device 60, transitions in thickness can be used to locate the leading edge of a first document of the document pair, and the leading edge of a second document of the document pair (relative to the first leading edge). By timing passage of the leading edge of the first document past a sensor located at the entry of the separation station 75 relative to passage of the leading edge of the first document past a sensor located at the exit from the separation station 75, it can be determined which document is the first to pass from between the rollers 78, 79 (and the separation station 75). This information can be used to time activation and deactivation of the braking mechanism 87, establishing an appropriate gap between the two documents as they are serially discharged from the separation station 75.

As previously indicated, timed activation and deactivation of the braking mechanism 87 can be used to establish a desired gap between the documents that are discharged from the separation station 75. However, also to be considered is that the amount of space (along the transport path) required to accommodate the separated documents relative to the amount of space formerly required to accommodate the corresponding envelopes, and the paired contents extracted from them, will increase as a result of the foregoing operations. This can be accommodated by leaving sufficient gaps between the envelopes, and the paired contents extracted from them, to accept the separated documents that are discharged from the separation station 75. However, this will tend to compromise the productivity (operating rate) of the extraction apparatus 1.

For this reason, it is preferable to increase the rate at which the separated documents are passed from the separation station 75, relative to the rate at which the paired documents are introduced to the separation station 75, to provide the additional space that is desired for accommodating the separated documents without compromising the productivity of the extraction apparatus 1. This is accomplished by passing documents received from the separation station 75 to paired belt systems 91 which follow the separation station 75 (in the preferred embodiment, the belt systems 91 are associated with a justification station 90 following the separation station 75), and which are caused to operate at a transport rate that is increased from the transport rate established for the paired belt systems 76 of the separation station 75. This increase in transport rate can be varied, as desired. A doubling of this rate is presently preferred. Irrespective of the increase in transport rate that is established, the maintenance of appropriate gaps between the documents is made possible by the array of sensors 89 of the separation station 75, by monitoring the passage of document edges from between the rollers 78, 79, and by timing operations of the braking mechanism 87 to regulate the discharge of documents from the separation station 75 as previously described. Resulting from this, a desired gap for the serially discharged documents can be reliably established.

As previously indicated, the above-described configuration for the separation station 75 will operate to separate paired, parallel documents for serial discharge from the separation station 75, without regard to which of the two documents is leading (e.g., the check or the invoice). Modification of the separation station 75 is possible to not only separate the paired, parallel documents, but to also establish the order in which the documents are discharged from such a separation station 75', if desired.

Figure 11:
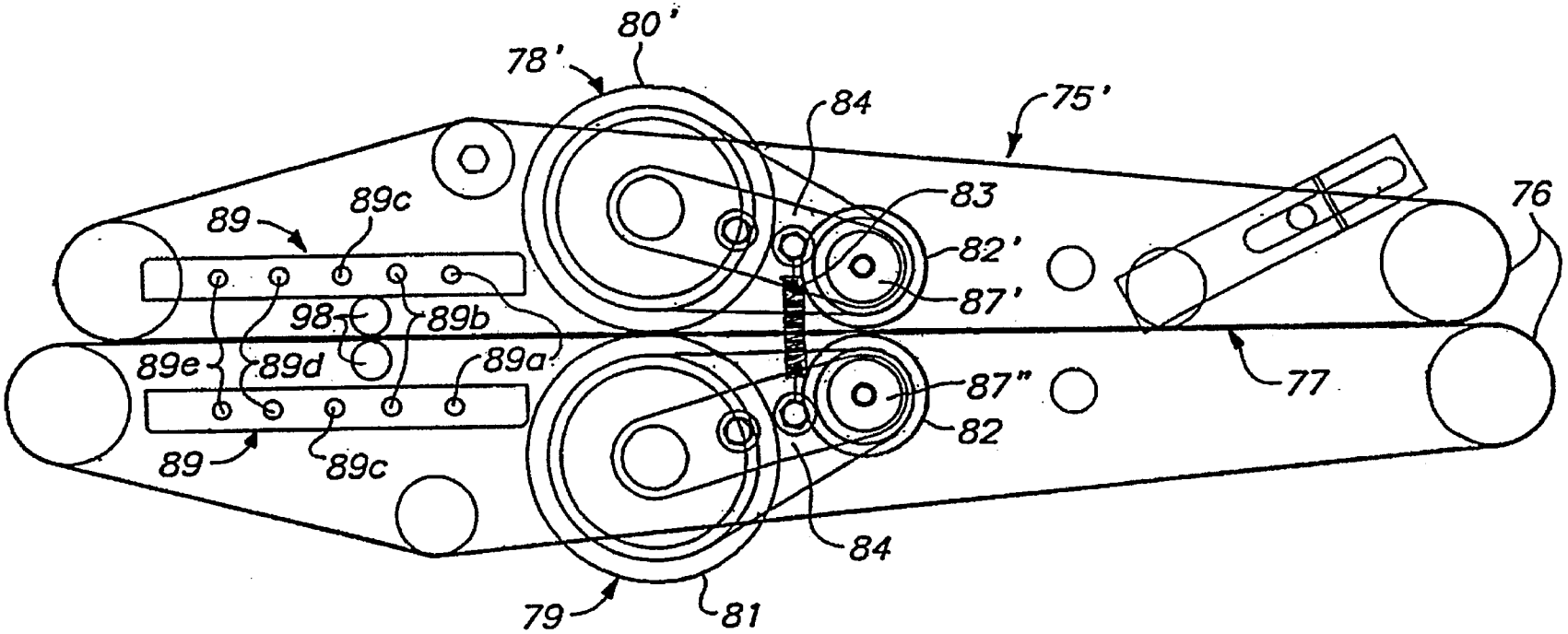
FIG. 11 is an enlarged elevational view of an alternative embodiment apparatus for separating paired, parallel documents for serial discharge.

To this end, and referring to FIG. 11, the idler roller 78 of FIG. 9 is replaced with a roller 78' that substantially corresponds to the roller 79. This preferably includes correspondence in the diameter of the roller 78', and the coefficient of friction established for the surface 80'. Additionally, both of the rollers 78', 79 are driven rollers, operated by the drive elements 82, 82'. Each of the drive elements 82, 82' further includes a clutch/brake mechanism 87', 87" for allowing rotation of either of the rollers 78', 79 to be discontinued responsive to selective activation and deactivation of the clutch/brake mechanisms 87', 87". This, in turn, allows a selection of which of the two documents present between the rollers 78', 79 is to lead, and which is to follow.

Paired rollers 98 are positioned to follow the rollers 78', 79, defining a nip for engaging the leading document as it is passed from between the rollers 78', 79. The rollers 98 are provided since there is no longer a difference between the coefficients of friction for the surfaces 80', 81. Because of this, there can be undesirable interaction between the rollers 78', 79 and a single document present between them. As a consequence, the location selected for the rollers 98 is important. Since the rollers 98 are provided to pull documents from between the rollers 78', 79, the nip defined by the rollers 98 will be tighter than the nip defined by the rollers 78', 79. It is therefore important to locate the rollers 98 sufficiently far from the rollers 78', 79 so that the rollers 98 will not engage either of the paired, parallel documents as they are received between the rollers 78', 79, and so that the rollers 98 will not engage the trailing-document (left between the rollers 78', 79) as the leading document is passed from between the rollers 78', 79. However, it is equally important that the rollers 98 reliably engage the leading document as it is passed from between the rollers 78', 79 (leaving the trailing document behind). For this reason, the distance from the rollers 98 to the rollers 78', 79 should be no greater than the shortest possible document to be handled for purposes of separation.

It is also for this reason that once the leading document is engaged by the rollers 98, the remaining clutch/brake mechanism is also activated, preventing rotation o of both of the rollers 78', 79 at that point. The result is that the leading document is pulled from between the rollers 78', 79, leaving the trailing document behind. Following this, the clutch/brake mechanisms 87', 87" are deactivated, allowing the second document to pass from between the rollers 78', 79. Again, the array of sensors 89 (or other equivalent means) is used to determine timing for operations of the clutch/brake mechanisms 87', 87", to regulate the gaps developed between the discharged documents as previously described.

As a result, by controlling which of the clutch/brake mechanisms 87', 87" is operated, the separation station 75' can now operate to select which of two documents is to lead, and which is to follow. Such selection can be accomplished responsive to appropriate signals indicative of the two documents. For example, this could include the detection of magnetic ink markings signifying a check (e.g., a MICR line or other distinctive markings), making use of a magnetic imaging device similar to the magnetic imaging device 7 associated with the detection station 5, and positioned in advance of the separation station 75'. Similar results can be achieved by identifying features on the documents (e.g., a MICR line or other distinctive markings on a check, or distinctive features of the accompanying invoice) making use of an image processing device similar to the image processing device 8 associated with the detection station 5, and positioned in advance of the separation station 75'. Such a determination could also be made for windowed envelopes, by previously determining (e.g., using the image processing device 8) which of the two envelope faces includes the window for the envelope, identifying which of the two documents (generally, the invoice) faces in that direction. Other means for detecting characteristics associated with the envelope and its contents are clearly possible.

In cases where at least one of the paired, parallel documents has magnetizable markings, such a determination can also be made by positioning a pair of magnetic imaging devices similar to the magnetic imaging device 7 of the detection station 5 in advance of the separation station 75', and on either side of the document transporting path. This allows signals to be derived from both sides of each document pair, for purposes of comparison. By comparing the strength of the derived signals, it can be determined whether magnetic ink (signifying the check) faces to one side or the other, or is located in the center. If it is determined that the magnetic ink faces to one side or the other, the order in which that document pair is being presented to the separation station 75' is fully determined. If it is determined that the magnetic ink is located in the center, determinations ordinarily made by either of the magnetic imaging devices in identifying document orientation can be used and compared to determine the order in which the document pair is being presented to the separation station 75'. For example, there are two possible orientations for a check facing either of the magnetic imaging devices, and two possible orientations for a check facing away from either of the magnetic imaging devices. By comparing the determinations made by the magnetic imaging devices, it can be determined which document includes the magnetic ink markings (i.e., the check), determining the order in which that document pair is being presented to the separation station 75'.

As an alternative, a single magnetic imaging device similar to the magnetic imaging device 7 of the detection station 5 can be positioned in advance of the separation station 75', on either side of the document transporting path. This allows signals to be derived that will vary in amplitude depending upon where the magnetic ink is located relative to the magnetic imaging device. By establishing three ranges of signal strength corresponding to the three possible locations for the magnetic ink (i.e., to either side or in the middle) and by making the orientation-identifying determinations ordinarily made by the magnetic imaging device, a determination can be made as to the order in which the document pair is being presented to the separation station 75'.

Following extraction from their envelopes, and their separation for serial processing, it is not uncommon for the documents to be skewed to some extent relative to the transport path along which they are conveyed. For procedures that are to follow, it is important for the documents to be uniformly oriented (i.e., justified) to a known reference, irrespective of the manner in which they are received from the separation station 75. For this reason, the separated documents are preferably introduced to a justification station 90. To this end, the paired belt systems 91 which receive the documents from the separation station 75 communicate with a justifying drum 92. A fixed guide 93 overlies the justifying drum 92, leaving sufficient space for documents to pass between the justifying drum 92 and the fixed guide 93 as the documents progress around the perimeter of the justifying drum 92. During this transition, steps are taken to urge each document into registration with a flange 94 formed along the bottom-most edge of the justifying drum 92. This is accomplished by a justifying roller 95, positioned to contact the documents as they pass between the guide 93 and the justifying drum 92. To this end, an aperture 96 is provided in the fixed guide 93 so that the justifying roller 95 can engage documents passing between the fixed guide 93 and the justifying drum 92, and the drum 92 is provided with a groove adjacent to the justifying roller 95 to avoid direct contact between the surface of the drum 92 and the justifying roller 95 (to reduce wear at this location). The justifying roller 95 includes an outer surface 97 formed of a friction promoting material, and is disposed at an angle relative to the justifying drum 92 that will cause documents to be urged into registration with the flange 94 as each document progresses around the justifying drum 92, as desired.

Following their discharge from the justification station 90, the documents are then preferably introduced to a detection station 100 for determining characteristics of the documents. It is for this reason that justification of the documents is preferred, prior to their introduction to the detection station 100. This ensures that the documents will be appropriately positioned for the analyses that follow. The detection station 100 can include any of a number of devices for determining characteristics of the documents that are being processed, much the same as the detection station 5 used to determine characteristics of the envelopes prior to the extraction of documents from them.

For example, a magnetic imaging device 101 is provided to analyze magnetic indicia associated with the documents received from the justification station 90. The magnetic imaging device 101 corresponds in structure to the magnetic imaging device 7 of the detection station 5. However, unlike the magnetic imaging device 7 of the detection station 5, the magnetic imaging device 101 of the detection station 100 serves primarily to determine the orientation of checks proceeding through the detection station 100. This information may then be used for purposes of reorienting the documents for discharge from the apparatus in a uniform orientation, or for sorting purposes, as desired. Again, further detail regarding specifics of the magnetic imaging device 101, and the manner in which this device may be used to identify the orientation of a check, may be had with reference to U.S. Pat. Nos. 5,240,116 and 4,863,037, and the orientation determining devices that they disclose.

An image processing device 102 is provided to acquire images from the opposing faces of each document as the documents proceed through the detection station 100. The image processing device 102 of the detection station 100 corresponds in structure to the image processing device 8 of the detection station 5. However, in this case, the image processing device 102 operates to acquire images from the opposing faces of each document, including both the invoice and its accompanying check. Again, further detail regarding specifics of the image processing device 102 may be had with reference to U.S. patent application Ser. No. 07/756,930, and the image processing device that it discloses.

Once acquired, the images corresponding to the faces of the documents proceeding through the image processing device 102 may be processed (in memory) to ascertain information pertaining to them. For example, it is possible to determine the orientation of such documents by comparing the acquired images to available reference standards. Of course, a determination of the orientation of checks is also made possible by the magnetic imaging device 101, if employed. However, the image processing device 102 can also determine the orientation of the accompanying invoices. The image processing device 102 can also perform certain document reading functions for ascertaining information contained on the documents. By using known character recognition techniques, steps can be taken to read dollar amounts or other information provided on the documents.

Since stored images of the documents are made available in memory, the acquired images can also be used for purposes of remittance processing, if desired. For example, it is possible to compare images acquired from an invoice, and images acquired from its corresponding check, to determine whether a payment is made in full, or only in part. This can be used for sorting purposes, or to direct such documents for remittance processing (to be discussed more fully below) according to whether or not they represent a full or partial payment. It is even possible to employ such images for purposes of submission to the banking system, provided the banking system accepts so-called "document-less" transactions. These various functions, and means for accomplishing them, will be discussed more fully below.

In any event, the documents are serially discharged from the detection station 100 with a full indication of desired characteristics for directing their further handling. It will be understood that the detection station 100 may include any of a variety of devices for purposes of identifying characteristic features associated with the documents. Either the magnetic imaging device 101 or the image processing device 102 may be deleted, if desired. Additional detection functions are also possible, by adding appropriate devices to the detection station 100. For example, a thickness measuring device similar to the thickness measuring device 6 of the detection station 5 could be added to the detection station 100, should this prove to be of use in a particular application. In any event, those detection devices that are employed may be placed in various different orders, as desired.

Resulting from operations of the detecting devices that are employed, the documents that are being handled can be identified by type, and analyzed as desired. As previously indicated, the extraction apparatus 1 is capable of receiving envelopes and, through operations primarily associated with the detection station 5 (or other detecting devices, as desired), marking the envelopes according to type, and their anticipated contents. By comparing (e.g., in memory) signals derived from the detection station 100 with signals previously derived from the detection station 5 (or elsewhere), it becomes possible to verify whether the contents extracted from the envelopes correspond to the anticipated contents of the earlier analyzed envelope, as well as to determine how the extracted contents are to be handled as they proceed through remaining portions of the extraction apparatus 1 (e.g., reoriented, stacked, remittance processed, etc.). Such content verification allows documents to be effectively handled irrespective of their intended disposition, and even though mixed by type and characteristic features.

Documents received from the detection station 100 are then introduced to an orientation station 105. The orientation station 105 includes various devices for subjecting the documents to desired reorientation steps responsive to signals received from the detection station 100 (or other detection devices associated with the extraction apparatus 1), and in accordance with the requirements desired for a particular application (i.e., the ultimate disposition of such documents).

A reordering device 110 is provided for altering the order of documents received by the orientation station 105. As previously indicated, the extraction apparatus 1 is often used to extract and process paired combinations of documents. This is most commonly encountered in connection with the handling of paired combinations of checks and invoices, for eventual remittance processing. Depending upon the remittance processing procedure which is to follow, it is often desirable that one or the other of the documents uniformly leads. For example, in many remittance processing operations, it is desirable for the invoice to be received first, so that the dollar amount shown on the subsequently received check can be compared with the amount shown on the invoice. Other operations may call for the reverse situation. For envelopes having windows (e.g., for showing a mailing address), the order of the documents extracted from each envelope will be known, so that the order of the documents discharged from the separation station 75 will also be known. However, this order may differ from the desired order for the further processing of such documents. This order may also differ for different batches of envelopes (i.e., different "jobs"). This order will be random for envelopes that do not have windows.

As previously discussed, the separation station 75' of FIG. 11 can selectively discharge documents, achieving a desired order for them. However, this requires additional equipment in advance of the separation station 75', to make the determinations that are necessary for the selective discharge of documents that is desired. This leads to added costs, and space utilization considerations associated with such additional equipment. Documents discharged from the separation station 75 of FIG. 9 will often be received in a random order.

In circumstances requiring a reordering of documents for any of the reasons previously discussed, the reordering device 110 operates to either pass documents through, or to reorder the documents, as desired. It is important to note that what is preferred is not merely to place the documents in an order that differs from their order when received by the reordering device 110, but rather to actually switch the location for the two documents. The reason for this is that other documents will necessarily follow, leaving only designated "slots" for accommodating the pair of documents to be switched. Shifting of the documents, as opposed to the switching of documents that is desired, could either result in exceedingly large gaps between the documents being processed (compromising processing rates) or the potential for an overlap of documents (leading to a potential "jam" of the apparatus).

Figure 12:
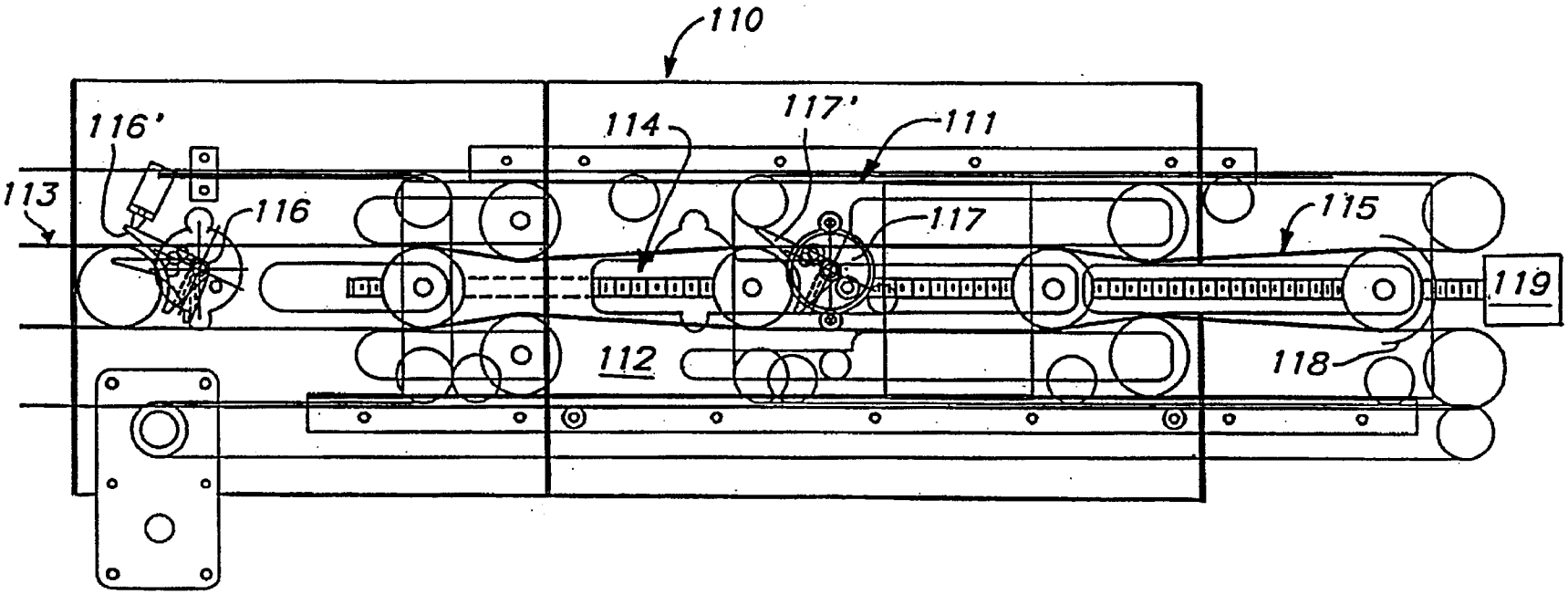
FIG. 12 is an enlarged elevational view of portions of the apparatus of FIG. 3 that are employed to change the order of received documents.

Referring to FIG. 12, the reordering device 110 includes an input belt system 111 and an output belt system 112 in spaced, juxtaposed relationship. A series of three transition belt systems 113, 114, 115 are located between the input belt system 111 and the output belt system 112. A first gating device 116 is positioned between the transition belt systems 113, 114, and a second gating device 117 is positioned between the transition belt systems 114, 115. Each of the gating devices 116, 117 is operated responsive to signals (received from the detection station 100, the detection station 5, or other detection devices associated with the apparatus 1) that are indicative of the order of the documents received by the reordering device 110. This may result from the detection of magnetic indicia associated with the documents (signifying a check or an invoice) by the magnetic imaging devices 7, 101, or may result from the processing of images (identifying an invoice or a check) acquired by the image processing devices 8, 102, employing magnetic and video pattern recognition techniques that are disclosed, for example, in U.S. patent applications Ser. No. 07/853,411 and Ser. No. 07/756,930.

In the event it is determined that the documents received by the reordering device 110 are in their desired order, the gating device 117 is activated so that its gate 117' overlies the input belt system 111, causing both of the documents to pass from the input belt system 111 to the output belt system 112. This occurs without altering the order of the documents, and without affecting their timed, spaced relationship to other documents (either leading or trailing) being processed by the extraction apparatus 1. Essentially, such documents are passed through the reordering device 110 without otherwise affecting them.

In the event it is determined that the order of the documents received by the reordering device 110 needs to be reversed, the leading document (which is later to be the trailing document) is passed along the input belt system 111 in cooperation with the transition belt systems 113, 114, 115. This document is then passed to a guide 118, in turn transferring the document to the output belt system 112. Following passage of the leading document, the gating device 116 is activated so that its gate 116' overlies the input belt system 111, passing the trailing document (which is to be the leading document) from the input belt system 111 to the output belt system 112. As a result, the former trailing document is positioned in advance of the former leading document, which is then proceeding along the belt system 112 as previously described, reversing the order of the two documents. Important to note is that by allowing the originally leading document to pass beyond the gating device 117, while deflecting the originally trailing document by the earlier positioned gating device 116, the order of the documents is not only reversed, but actually switched (relative to one another), leaving the switched pair of documents in their original, overall order relative to the remaining documents being processed by the extraction apparatus 1.

The above-described procedures define three paths of a fixed length for handling the documents that are being processed. These path lengths will vary for documents of different sizes (resulting from different extracting jobs). This can be accommodated by ensuring that the several path lengths are sufficient to accommodate the longest possible documents to be handled by the reordering device 110. However, in order to further optimize the handling of documents by the reordering device 110, paper paths of adjustable length are preferred. To this end, the transition belt systems 114, 115 and the gating device 117 can be mounted to a motorized lead screw 119 for adjusting the lengths of the several paper paths by moving the transition belt systems 114, 115 and the gating device 117 from side to side. Such movement can be controlled responsive to known parameters specified for a particular job. In the alternative, such movement can be controlled responsive to measured document lengths (for a particular job) detectable by timed passage of the documents past suitably positioned photodetectors associated with the extraction apparatus 1 (e.g., as part of the detection station 100). Such movements are presently not fast enough to allow such adjustments to be performed while a particular job is being processed. Consequently, for so-called "mixed jobs", those with documents of differing lengths, the desired adjustments are made to accommodate the median document anticipated for a given job.

A document reversing device 120 is provided for inverting receiving documents from end to end, reversing them so that their leading edge, as received, forms the trailing edge of the document as it is discharged from the document reversing device 120. In the configuration of FIGS. 1 to 3, the document reversing device 120 communicates with the reordering device 110. Initially, all documents received by the document reversing device 120 will first encounter a gating device 121. The gating device 121 operates to direct documents between a transport path 122 for subjecting documents to a reversing procedure, and a transport path 123 for bypassing the reversing procedure. The transport path 123 is defined by paired belt systems 124, and preferably has a length that substantially corresponds to the length of the path established through the document reversing device 120. As a result, the documents subjected to a reversing procedure will take the same amount of time to handle as will the documents that are not subjected to a reversing procedure, so that there is no difference in terms of their spacing relative to the other documents being processed by the extraction apparatus 1.

Figure 13:
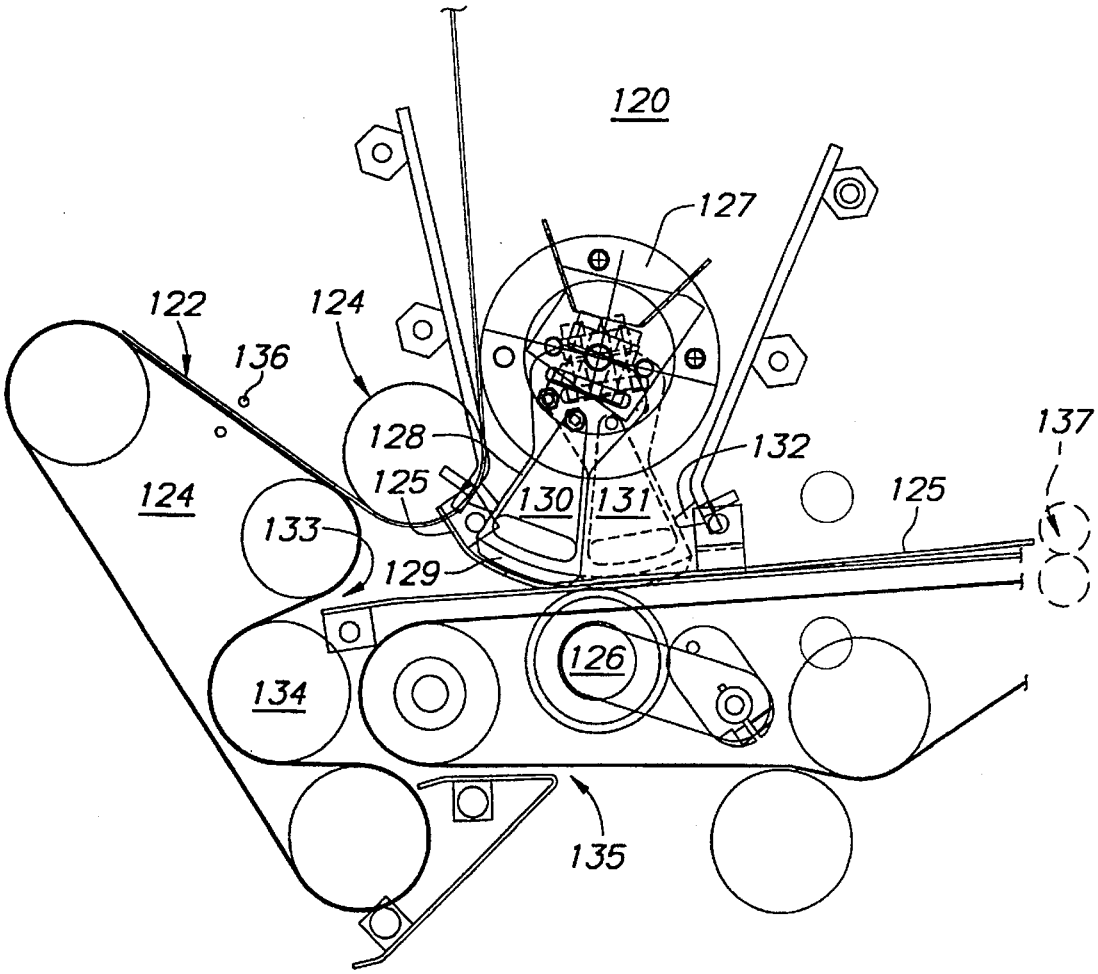
FIG. 13 is an enlarged elevational view of portions of the apparatus of FIG. 3 that are employed to reverse documents from end to end.

Referring to FIG. 13, the documents to be subjected to a reversing procedure are passed from the transport path 122 to a free space defined between a fixed guide 125 and an idler roller 126. The fixed guide 125 and the idler roller 126 are spaced so that a document can freely slide between them as the document is received from the transport path 122. To this end, the fixed guide 125 is preferably curved along its leading and trailing edges, as shown.

A rotary solenoid 127 is provided which receives a cam 128 that extends from the solenoid 127 toward the fixed guide 125 and the idler roller 126, extending over the fixed guide 125. Lateral edges of the cam 128 are provided with friction-producing pads 129, for engaging documents received between the fixed guide 125 and the idler roller 126 as will be discussed more fully below.

In operation, when the solenoid 127 is inactive, the cam 128 is biased (by a spring or equivalent means) into the position shown at 130, so that the pads 129 do not engage either the idler roller 126 or the document which is then being transferred from the transport path 122 to the gap developed between the fixed guide 125 and the idler roller 126. Upon activation of the solenoid 127, the cam 128 is driven to an active position (shown in phantom at 131), engaging an end stop 132. In this position, the pads 129 are caused to "pinch" a document against the idler roller 126, stopping forward motion of the document into the gap developed between the fixed guide 125 and the idler roller 126. Following this, the solenoid 127 is deactivated, snapping the cam 128 back to its initial position 130. This operates to in essence "throw" the pinched document toward a nip 133. Although use of the rotary solenoid 127 is preferred, similar results can be achieved using other driving mechanisms, if desired.

By correctly timing such operations, the trailing edge of a document can be pinched between the pads 129 and the idler roller 126, and then introduced to the nip 133, reversing the document from end to end. Such documents are then drawn around a transition roller 134, and passed to a discharge point 135 which corresponds to the end of the transport path 123 for receiving documents that are to bypass the document reversing device 120. As an alternative to the transport path 123, all documents could be passed along the transport path 122, engaging documents to be reversed as previously described, and allowing documents that are not to be reversed to pass freely between the guide 125 and the idler roller 126 (by not activating the solenoid 127 for such documents). Documents passing between the guide 125 and the idler roller 126 would then be received by appropriate means (schematically represented by the rollers 137 shown in phantom in FIG. 13) for accepting and handling the documents that are not to be subjected to a reversal procedure.

In any event, operations of the solenoid 127 are timed responsive to movement of the documents along the transport path 122. To this end, an appropriate sensor 136 (e.g., a photodetector) is provided to detect the leading edge of a document passing along the transport path 122. Release of the solenoid 127 can either be fixed, in timed relation to its activation, or responsive to passage of the trailing edge of the document past the sensor 136. In either case, the time that it takes for documents to pass through the document reversing device 120 can be controlled, and varied if desired.

Although use of the document reversing device 120 is preferred because of its versatility and simplicity, it is also possible to employ other document reversing devices for similar purposes, such as the document reversing device that is disclosed in U.S. Pat. Nos. 5,115,918 and 4,863,037.

A document inverting device 140 is provided for inverting received documents from top to bottom (and vice versa). In the configuration of FIGS. 1 to 3, the document inverting device 140 communicates with the document reversing device 120, receiving documents from the discharge point 135. Initially, all documents received by the document inverting device 140 will first encounter a gating device 141. The gating device 141 operates to direct documents between a transport path 142 for subjecting documents to an inverting procedure, and a transport path 143 for bypassing the inverting procedure. The transport path 143 is defined by paired belt systems 144, and preferably has a length that substantially corresponds to the length of the path established through the document inverting device 140. As a result, the documents subjected to an inverting procedure will take the same amount of time to handle as will the documents that are not subjected to an inverting procedure, so that there is no difference in terms of their spacing relative to the other documents being processed by the extraction apparatus 1.

Documents to be subjected to an inverting procedure are passed from the transport path 142 to cooperating belt systems 145 for drawing the documents along a path that twists (i.e., rotates 180 degrees) as it progresses through the document inverting device 140, inverting the documents from top to bottom (and vice versa). For further detail regarding specifics of the document inverting device 140, reference is made to U.S. Pat. No. 4,863,037, and the twisting station that it discloses.

Following discharge from the document twisting device 140, each of the series of documents to be processed through the extraction apparatus 1 may be reoriented, as desired, for subsequent handling. However, as previously indicated, such reorientations are optionally accomplished, if desired for a particular application. Other applications may call for documents to be processed without reorienting them, or for some, but not all of the above-described reorienting procedures to take place. To this end, the reordering device 110, the document reversing device 120 and the document twisting device 140 are each capable of being included, or deleted, as desired. It is also possible to vary the order of included devices, depending upon convenience and the specific devices that are employed.

It is also important to note that each device associated with the orientation station 105 can either reorient a document, or pass a document through without subjecting that document to reorientation. Activation of the devices associated with the orientation station 105 is therefore entirely optional, depending upon the application involved.

As previously indicated, the extraction apparatus 1 of the present invention is capable of handling documents substantially irrespective of their condition and their characteristic features. This allows the extraction apparatus 1 to handle not only the previously preferred document pairs including a check and an invoice, but also many other documents that could not otherwise have been handled. This is again facilitated by the separation station 75, the justification station 90, the detection station 100 and the orientation station 105, which are capable of receiving documents and passing them through substantially irrespective of the condition and characteristic features of such documents. This is permitted by passing such documents through the separation station 75, the justification station 90, the detection station 100 and the orientation station 105, and operating upon the documents to the extent desired, without operating upon the documents in some way that could compromise (e.g., jam) the extraction apparatus 1. If desired, those documents that are deemed inappropriate for further processing can either be diverted from further processing, for collection in the outsort bins 68 as previously described, or passed through the remainder of the extraction apparatus 1, for separate collection following their discharge from the orientation station 105. As a consequence, while it would be possible to employ a separation station, a justification station, a detection station and/or an orientation station comprised of other devices, such as those disclosed in U.S. Pat. No. 5,310,062 or U.S.

Pat. No. 4,863,037, among others, use of the separation station 75, the justification station 90, the detection station 100 and the orientation station 105 is preferred because of their versatility and simplicity.

In any event, documents delivered from the orientation station 105 are then introduced to a justification station 150. The document orienting functions accomplished by the orientation station 105 will often result in an irregular delivery (i.e., skewing) of documents from the orientation station 105. Justification of the documents to a known reference is therefore preferred at this point to facilitate the subsequent handling of such documents. Although not essential, such justification is often important to ensure that the documents are appropriately delivered from the extraction apparatus 1 to the output device (or devices) with which it is associated. In terms of its operation, the justification station 150 is identical to the justification station 90 previously described.

Following their handling, documents are passed from the extraction apparatus 1 by paired belt systems 151 that terminate at a delivery point 152. These documents can be a series of alternating checks and invoices, for handling on a priority basis. This series of documents may be ordered, oriented, or randomly discharged, depending upon the devices employed in a particular extraction apparatus, and the intended disposition for such documents. However, as previously indicated, other types of documents can also be discharged from the delivery point 152, if desired. These documents can be other types of paired documents, as well as single documents or multiple documents that have been extracted from the envelopes associated with a particular job, or a mixed job, including contents that are uniform, or mixed in terms of their characteristic features. Again, this series of documents may be ordered, oriented, or randomly discharged, depending upon the devices employed in a particular extraction apparatus, and the intended disposition for such documents, and can be either separate, or connected by various implements. Any of a variety of documents can be effectively handled by the extraction apparatus 1, if desired.

The extraction apparatus 1 is adapted for communication with a variety of devices for receiving documents discharged from the extraction apparatus 1, and for further processing these documents as desired. For example, the extraction apparatus 1 of FIGS. 1 to 3 communicates with a series of stacking units 155–162. The stacking units 155–162 operate to receive documents delivered from the extraction apparatus 1, generally responsive to sorting signals that are also received from the extraction apparatus 1. A series of gating devices 163 are provided to distribute documents between the several stacking units 155–162 depending upon the desired distribution for such documents.

A variety of sorting procedures may be accomplished in this fashion. Documents may be sorted according to their type, their orientation (in the event that the documents have not previously been oriented), their order (in the event that the documents have not previously been reordered), or to receive selected (e.g., exceptional) documents that have been passed from the extraction apparatus 1. Suitable signals for this are derivable from the detection stations 5, 100, the various sensors associated with the remainder of the extraction apparatus 1, or other information sensing equipment provided for such purposes. Such signals are also receivable from the overall control system responsible for coordinating the various operations of the extraction apparatus 1 (e.g., for purposes of clearing the apparatus following a detected jam). In any event, further detail regarding the stacking units 155–162, the manner in which the gating devices 163 are operated to distribute documents to and between the stacking units 155–162, and the types of control functions that can be used to direct documents to and between the stacking units 155–162, may be had with reference to U.S. Pat. No. 4,863,037 and the stacking station that it discloses.

Figure 14:
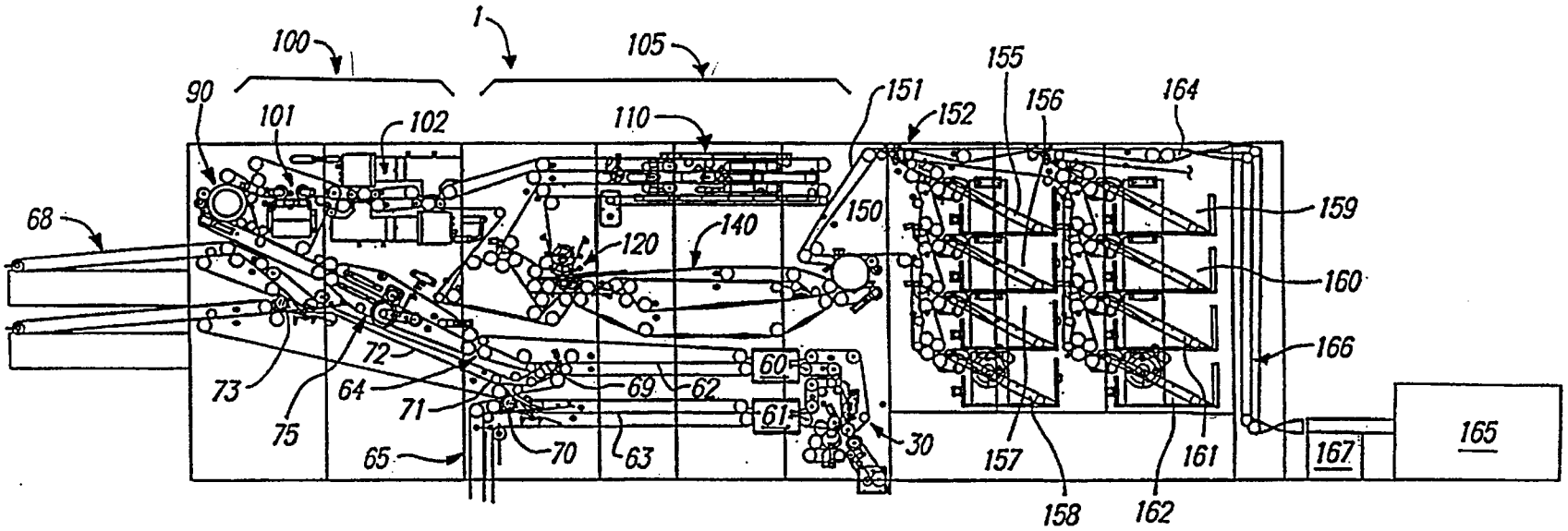
FIGS. 14 to 18 are side elevational views of portions of the apparatus of FIG. 3, and alternatives for communicating with remittance processing equipment.

The stacking units 155–162 also include paired belt systems 164 for communicating with other equipment, if desired. For example, as is schematically shown in FIG. 14, the extraction apparatus 1 can communicate with available remittance processing equipment 165. To this end, the paired belt systems 164 communicate with transition belt systems 166. The transition belt systems 166 operate to deliver documents to a so-called "distribution node" 167 for communicating with the remittance processing equipment 165 as disclosed in U.S. Pat. No. 5,310,062. To accomplish this, the transition belt systems 166 operate to receive documents from the paired belt systems 164, to lower the documents to a height appropriate for communicating with the distribution node 167, and to reorient the documents from the generally flat, horizontal orientation in which they are received from the extraction apparatus 1 to a generally upright, vertical orientation appropriate for delivery to the distribution node 167. This allows the extraction apparatus 1 to be directly coupled with appropriate remittance processing equipment 165, leading to a fully integrated mail handling operation.

Figure 15:
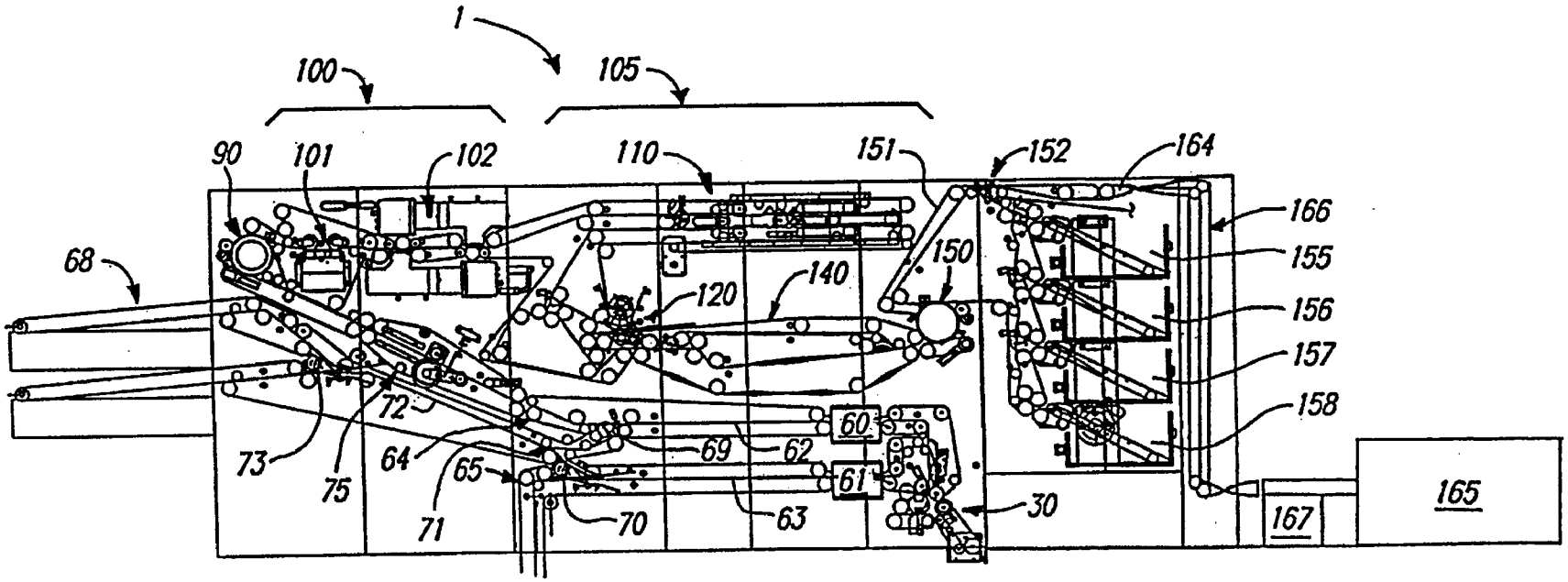
Figure 16:
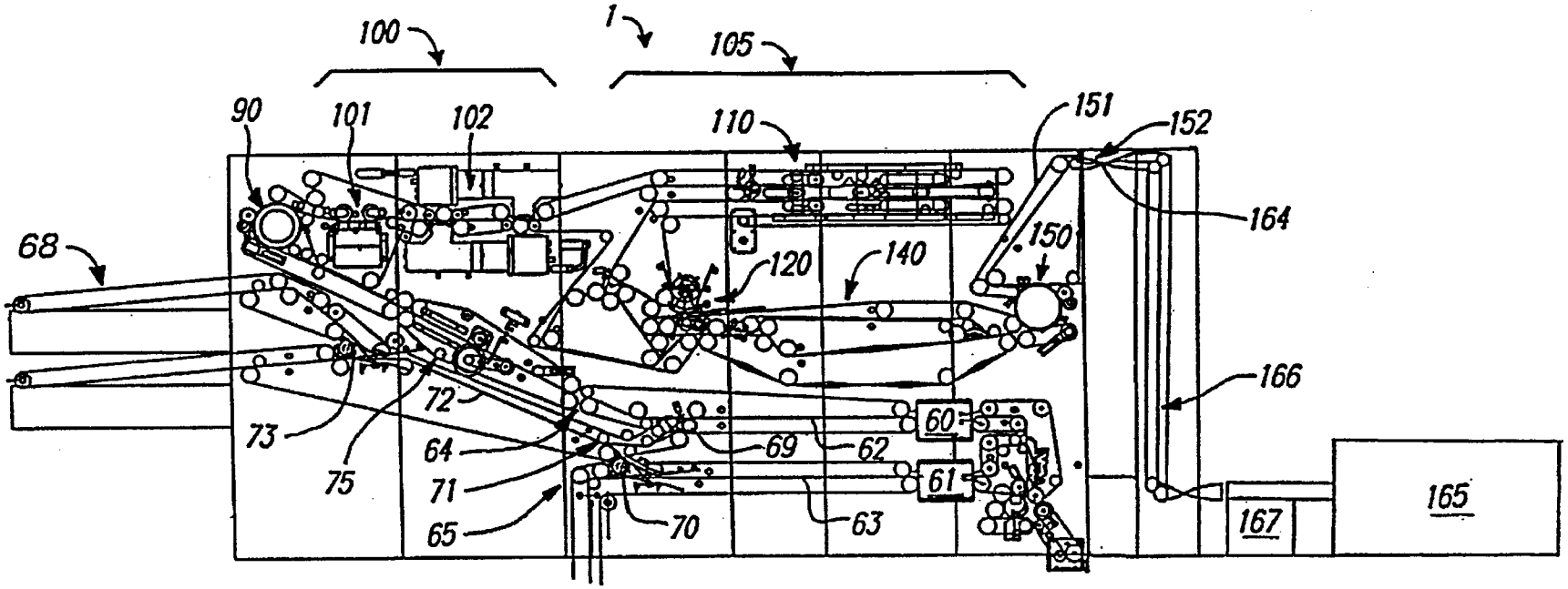

To be noted is that in such case, it will generally not be necessary to provide a significant number of stacking units for outsorting purposes since it will generally be possible to direct a significant portion of the extracted documents to the remittance processing equipment 165. Moreover, such operations will generally employ an orientation station 105 incorporating a reordering device 110 (unless the modified separation station 75' is employed), a document reversing device 120 and a document inverting device 140. As a result, it will generally be possible to employ fewer stacking units. For example, referring to FIG. 15, only four stacking units 155–158 are provided for outsorting purposes. Referring to FIG. 16, it is even possible for the transition belt systems 166 to be directly coupled with the delivery point 152 of the extraction apparatus 1, causing all extracted documents to be delivered to the remittance processing equipment 165. However, this is presently considered to be less preferred since there is no longer an opportunity to remove documents from further processing.

Figure 17:
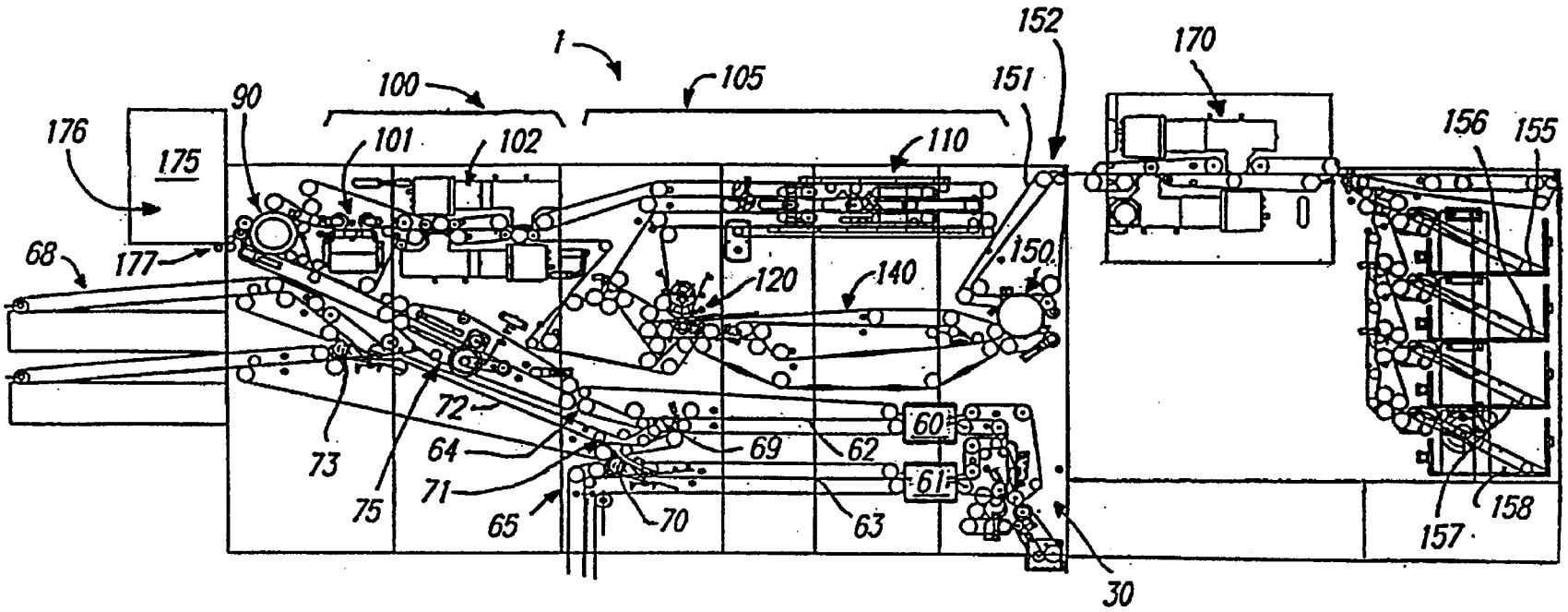

The extraction apparatus 1 can communicate with other types of devices, if desired. For example, some remittance processing procedures take steps to acquire images from the documents being processed, either to facilitate the remittance processing of such documents (e.g., to identify invoices that have been paid in part and invoices that have been paid in full), or for purposes of archiving the transactions that have been reported (e.g., in conjunction with the so-called "truncated" remittance processing of checks, that then need not be returned to their point of origin). Referring to FIG. 17, this can be accomplished by placing an image processing device 170 in communication with the delivery point 152 of the extraction apparatus 1, for acquiring images from the documents that are passed from the extraction apparatus 1 (for subsequent "export" of the acquired images for purposes of their remittance processing). The image processing device 170 is structurally similar to the image processing devices 8, 102 previously described. However, the image processing device 170 will generally be configured to recognize information appropriate to the remittance processing of documents, rather than to operations of the extraction apparatus 1. Such image processing devices are known and available from manufacturers of remittance processing equipment. It would also be possible to configure the image processing device 102 to perform a similar function, eliminating the need for the image processing device 170, if desired.

The image processing device 170 (or, if desired, the image processing device 102) can be configured and combined with other data detecting devices to provide a full set of remittance processing functions. For example, an optical character recognition device can be employed to scan (i.e., read) information provided on the documents. A magnetic ink character recognition device can be employed to similarly scan information provided on documents bearing magnetic ink. The image processing device 170 (or the image processing device 102) can be employed to ascertain similar data fields, to confirm data fields identified by the optical character recognition device or the magnetic ink character recognition device, or to ascertain additional data fields, as desired. It is even possible to include an encoding device for encoding checks associated with the documents that are being processed, providing the extraction apparatus 1 with a fully integrated remittance processing function (in essence, merging the remittance processing equipment with the extraction apparatus). Either one or both sides of the documents may be subjected to the foregoing procedures, as desired, provided the documents are appropriately oriented for interaction with the data detecting devices that are employed.

As an alternative, the documents may be analyzed by the data detecting devices that are employed, so that those documents which can be successfully analyzed are appropriately handled, and so that those documents which cannot be successfully analyzed are sorted and stacked for separate handling. Such separate handling can include handling on equipment separate from the extraction apparatus 1. However, such separate handling can also be performed with the extraction apparatus 1, if desired. To this end, the extraction apparatus 1 shown in FIG. 17 includes a document feeding device 175 which can receive documents and introduce them to the document handling portions of the extraction apparatus 1 that have previously been described. The document feeding device 175 can therefore be used to re-introduce documents that could not previously be analyzed, following whatever steps are appropriate toward making such documents appropriate for analysis within the extraction apparatus 1 (e.g., following a reorientation of the documents, a separation of connected documents, etc.). The document feeding device 175 can also be used to introduce documents to the extraction apparatus 1 that have been obtained from other sources (e.g., other extraction equipment), and which need not be subjected to an extraction procedure.

The document feeding device 175 includes a bin 176 for receiving a quantity of documents (of a same or different type) and a feeding device 177 for withdrawing documents from the bin 176 and for introducing them to the extraction apparatus 1 (generally serially and one at a time). The document feeding device 175 can communicate with the extraction apparatus 1 at various locations along its transport path. However, an introduction of documents to the extraction apparatus 1 following the separation station 75 and in advance of the justification station 90 is presently preferred. This then allows the documents to be serially discharged from the feeding device 175, for introduction to the justification station 90, readying the introduced documents for the document handling procedures which are to follow (and which can be varied, if desired).

As previously indicated, documents extracted from envelopes can be marked (electronically tagged) either responsive to the envelopes which contained them, or responsive to detecting functions offered by the detection station 100. Documents introduced by the document feeding device 175 can similarly be marked (electronically tagged) responsive to detecting functions of the detection station 100 (or other detection devices associated with the extraction apparatus 1). By subjecting the documents to appropriate document handling and data detecting functions available through operations of the extraction apparatus 1 as previously described, steps can be taken to subject documents to a complete (or partial) remittance processing procedure. This can include data acquisition, document encoding (in a single pass or a plurality of passes) and sorting functions associated with the marking of documents for appropriate handling (including the tagging of documents that are authorized for truncated handling), the exporting of images to image key entry terminals, the printing of audit trails (including audit trails for purposes of batch reassociation, if required), as well as various functions that are appropriately and traditionally handled in software (e.g., assembly of batch balances, or item balances, transaction of account credits, and sorting functions associated with conventional banking practices including sorting by transit route number for obtaining favorable deposit fees and timing on credits, etc.). The extraction apparatus 1 would preferably include a printer for the effective implementation of such functions. Resulting from the foregoing improvements, the extraction apparatus 1 is capable of performing a variety of remittance processing functions which had previously required separate and substantial equipment for doing so.

Figure 18:
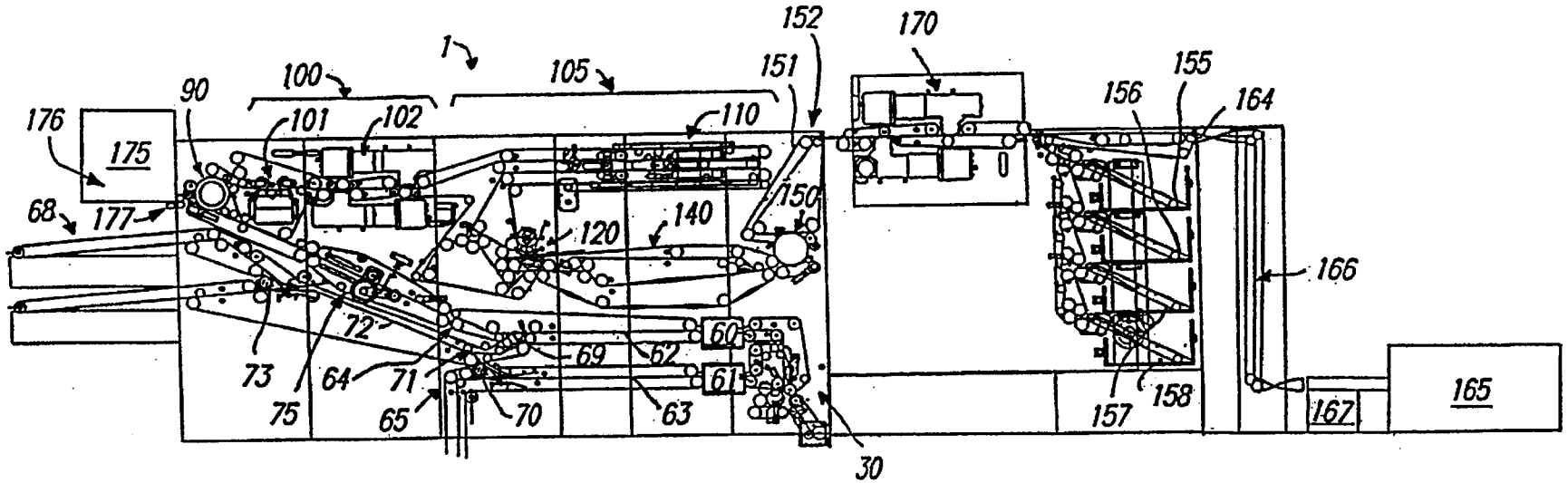

Following the acquisition of data from the documents (including acquired images, OCR data, MICR data, etc.), the acquired data can then be used to perform the remittance processing of such documents. For those documents that are no longer essential to the remittance processing that is to follow (e.g., checks that are approved for truncation), the resulting documents are then advantageously collected in the stacking units 155–159, for retention purposes. If such documents are being handled with other documents for which truncated handling has not been authorized, remaining documents (other than those for which truncated handling has been authorized) can be passed on to suitable remittance processing equipment 165, as shown in FIG. 18. Alternatively, such documents may be reintroduced to the extraction apparatus 1 (e.g., using the document feeding device 175), in essence providing a second pass at such documents. During this second pass, the checks can be encoded based on an externally created file (created, for example, with available remittance processing equipment communicating with the extraction apparatus 1 through a local area network) by matching the previously imprinted control number (from the file) with the check, and by applying the dollar amount that has been entered (as the paid amount) for that check.

It will therefore be understood that various changes in the details, materials and arrangement of parts which have been herein described and illustrated in order to explain the nature of this invention may be made by those skilled in the art within the principal and scope of the invention as expressed in the following claims.

What is claimed is:

1. An apparatus for changing the order of documents in a series including a first document that is leading and a second document that is trailing, and for reversing the order of the first document and the second document so that the second document is leading and the first document is trailing, comprising:

means for conveying documents along a first transport path for receiving the documents within the apparatus;

means for conveying documents along a second transport path for delivering the documents from the apparatus; and means for transferring the documents from the first transport path to the second transport path, including;

a direct transfer path for receiving the first document that is Leading and the second document that is trailing from the first transport path, and for transferring the first document and the second document to the second transport path so that the first document is leading and the second document is trailing; and spaced transfer paths located on opposite sides of the direct transfer path for receiving the first document that is leading and the second document that is trailing from the first transport path, and for transferring the second document that is trailing to the second transport path at a location ahead of the first document that is leading.

2. The apparatus of claim 1 wherein the first document is switched with the second document.

3. The apparatus of claim 2 wherein the first document is switched with the second document without shifting spacing of the first document and the second document relative to other documents received by the apparatus.

4. The apparatus of claim 1 wherein the direct transfer path lies symmetrically between the spaced transfer paths.

5. The apparatus of claim 1 wherein the first transport path and the second transport path are defined by conveyors, and the direct transfer path includes first gating means for deflecting documents from the conveyor defining the first transport path, toward the conveyor defining the second transport path.

6. The apparatus of claim 5 wherein the spaced transfer paths include second gating means for deflecting documents from the conveyor defining the first transport path to the conveyor defining the second transport path, and located on one side of the first gating means, and a transfer conveyor for passing documents from the conveyor defining the first transport path to the conveyor defining the second transport path, and located on another side of the first gating means opposite to the second gating means.

7. The apparatus of claim 6 wherein the first gating means follows the second gating means relative to documents conveyed along the first transport path.

8. The apparatus of claim 6 wherein the second gating means deflects the second document that is trailing from the conveyor defining the first transport path to the conveyor defining the second transport path, while the transfer conveyor conveys the first document that is leading along the conveyor defining the first transport path and the conveyor defining the second transport path.

9. The apparatus of claim 6 wherein the direct transfer path and the spaced transfer paths are variable in length.

10. The apparatus of claim 9 wherein the direct transfer path and the spaced transfer paths have lengths corresponding to the longest of documents to be conveyed through the apparatus.

11. The apparatus of claim 9 which further includes means for adjusting the lengths of the direct transfer path and the spaced transfer paths.

12. The apparatus of claim 11 wherein the adjusting means is a lead screw connecting conveyor means following the first gating means and the second gating means.

13. The apparatus of claim 12 which further includes a motor for rotating the lead screw, for moving the conveyor means following the first gating means and the second gating means.

14. The apparatus of claim 1 which further includes a document reverser for reversing select documents from end to end, so that a leading edge of each select document is switched with a trailing edge of the document, comprising:

a receiver for slidingly accepting select documents conveyed into the apparatus;

a roller associated with the receiver and including an outer surface in communication with the receiver; and a cam movable between a first position which does not contact the select documents accepted by the receiver, and a second position for engaging portions of the select documents accepted by the receiver between the cam and the roller, and for discharging the select documents from the apparatus.

15. The apparatus of claim 14 which further includes a first transport path for reversing select documents from end to end, a second transport path for conveying documents without reversing the documents from end to end, and gating means for selectively directing documents between the first transport path and the second transport path.

16. The apparatus of claim 15 wherein the first transport path has a length, and the second transport path has a length that substantially corresponds to the length of the first transport path.

17. The apparatus of claim 14 wherein the receiver includes a fixed guide for overlying the roller.

18. The apparatus of claim 14 wherein the cam includes pads for engaging the documents accepted by the receiver.

19. The apparatus of claim 14 which further includes moving means for moving the cam between the first position and the second position.

20. The apparatus of claim 19 wherein the moving means includes a solenoid for moving the cam from the first position to the second position, and a spring for moving the cam from the second position to the first position.

21. The apparatus of claim 19 which further includes means for moving the cam to the second position when the trailing edge of a select document is located within the receiver, in alignment with the roller.

22. The apparatus of claim 21 which further includes sensor means for detecting an edge of the select document, and means in communication with the sensor means for timing movement of the cam to the second position responsive to detection of the edge by the sensor means.

23. The apparatus of claim 21 including a nip and wherein movement of the cam to the first position directs the engaged trailing edge of the select document toward the nip for receiving the document with the trailing edge leading and the leading edge trailing, thereby reversing the document from end to end.

* * * * *